US012497889B2

(12) United States Patent
Steil DiLorenzo et al.

(10) Patent No.: US 12,497,889 B2
(45) Date of Patent: Dec. 16, 2025

(54) WIRELINE CONVEYED CASING TEST TOOL

(71) Applicant: Chevron U.S.A. Inc., San Ramon, CA (US)

(72) Inventors: Neil Robert Steil DiLorenzo, Houston, TX (US); Andre Jermaine Hicks, Houston, TX (US); Travis Carlo Louden, Middleburg, FL (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 18/659,163

(22) Filed: May 9, 2024

(65) Prior Publication Data

US 2025/0347220 A1 Nov. 13, 2025

(51) Int. Cl.
*E21B 47/117* (2012.01)
*E21B 33/12* (2006.01)
*E21B 43/116* (2006.01)

(52) U.S. Cl.
CPC ..... *E21B 47/117* (2020.05); *E21B 33/1208* (2013.01); *E21B 43/116* (2013.01)

(58) Field of Classification Search
CPC ... E21B 47/117; E21B 33/1208; E21B 43/116
See application file for complete search history.

(56) References Cited

U.S. PATENT DOCUMENTS

| | | | | |
|---|---|---|---|---|
| 5,180,009 | A * | 1/1993 | Sneed | E21B 23/10 166/383 |
| 8,127,846 | B2 * | 3/2012 | Hill | E21B 23/14 166/153 |
| 9,650,857 | B2 * | 5/2017 | Mailand | E21B 43/116 |
| 9,745,847 | B2 * | 8/2017 | Ditzler | E21B 43/26 |
| 10,428,623 | B2 * | 10/2019 | Silva | E21B 41/00 |
| 10,934,809 | B2 * | 3/2021 | Becker | E21B 41/00 |
| 2015/0252643 | A1 * | 9/2015 | Mailand | E21B 23/08 166/250.01 |
| 2020/0386076 | A1 * | 12/2020 | Becker | E21B 33/12 |
| 2021/0047898 | A1 * | 2/2021 | Garcia | E21B 33/16 |
| 2022/0049590 | A1 * | 2/2022 | Dennis | E21B 23/14 |
| 2024/0295168 | A1 * | 9/2024 | Kalenchuk | E21B 43/267 |

* cited by examiner

*Primary Examiner* — Steven A MacDonald
(74) *Attorney, Agent, or Firm* — Smith & Woldesenbet Law Group, PLLC

(57) ABSTRACT

A method for isolating a wet shoe sub in a horizontal section of a wellbore may include inserting a wireline tool assembly to the horizontal section of the wellbore, where the wireline tool assembly includes a wireline conveyed casing test tool. The method may also include releasing the wireline conveyed casing test tool from a remainder of the wireline tool assembly within the horizontal section of the wellbore. The method may further include perforating, using a gun string and after confirming that the wireline conveyed casing test tool is lodged against a seat of the wet shoe sub to create a seal with the seat of the wet shoe sub, a portion of the horizontal section of the wellbore upstream from the wet shoe sub after the wireline conveyed casing test tool is lodged against the seat of the wet shoe sub.

12 Claims, 11 Drawing Sheets

WIRELINE CONVEYED CASING TEST TOOL

TECHNICAL FIELD

The present application is related to subterranean field operations and, more particularly, to wireline conveyed casing test tools.

BACKGROUND

On "toe preps" for a "wet shoe system" the objectives are to 1) pressure test the casing, 2) isolate the wet shoe for hydraulic fracturing, and 3) to implement the first stage perforations. Some additional "toe sleeve" or "toe port" systems allow for injection to convey the gun string, and may require isolation above the point of injection to obtain a casing test to the desired pressure. In the current art, a common method to implement a "toe prep" is to pump a fracturing plug or bridge plug ("plug") down to depth from the surface, set the plug, and isolate the wet shoe or point of injection to obtain a casing test. After the casing test, the first stage is perforated.

When a plug is pumped downhole from the surface, there is a risk that the plug will "preset", which means that the plug goes through the setting process early and becomes stuck before being placed at the desired depth. Plugs can also become stuck before reaching the desired depth. When a plug sets early (i.e., is "preset") or becomes stuck, typically a coil unit must be obtained, rigged up, and deployed downhole to drill out the preset plug. This process can delay the rig up and implementation of the fracturing operation. Overall, a preset plug can cost significant amounts of time and money to a project.

SUMMARY

In general, in one aspect, the disclosure relates to a method for isolating a wet shoe sub or point of injection in a horizontal section of a wellbore. The method can include inserting a wireline tool assembly to the horizontal section of the wellbore, where the wireline tool assembly comprises a wireline conveyed casing test tool. The method can also include releasing the wireline conveyed casing test tool from a remainder of the wireline tool assembly within the horizontal section of the wellbore using a setting tool typically used for frac plugs, bridge plugs, and dummy plugs. The method can further include perforating, using a gun string and after confirming that the wireline conveyed casing test tool is lodged against a seat of the wet shoe sub to create a seal with the seat of the wet shoe sub, a portion of the horizontal section of the wellbore upstream from the wet shoe sub after the wireline conveyed casing test tool is lodged against the seat of the wet shoe sub.

In another aspect, the disclosure relates to a wireline conveyed casing test tool. The wireline conveyed casing test tool can include a body having a maximum diameter and a distal end, where the distal end includes a graduated diameter that increases to the maximum diameter, where the maximum diameter is configured to be larger than a seat diameter of a seat of a wet shoe sub, where the maximum diameter is configured to be smaller than a cavity diameter of the wet shoe sub, and where the distal end is configured to complement the seat of the wet shoe sub so that the distal end is configured to form a seal with the seat when the distal end abuts against the seat of the wet shoe sub.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, the same reference numerals used in different figures may designate like or corresponding but not necessarily identical elements.

DESCRIPTION OF THE INVENTION

Figure 1:
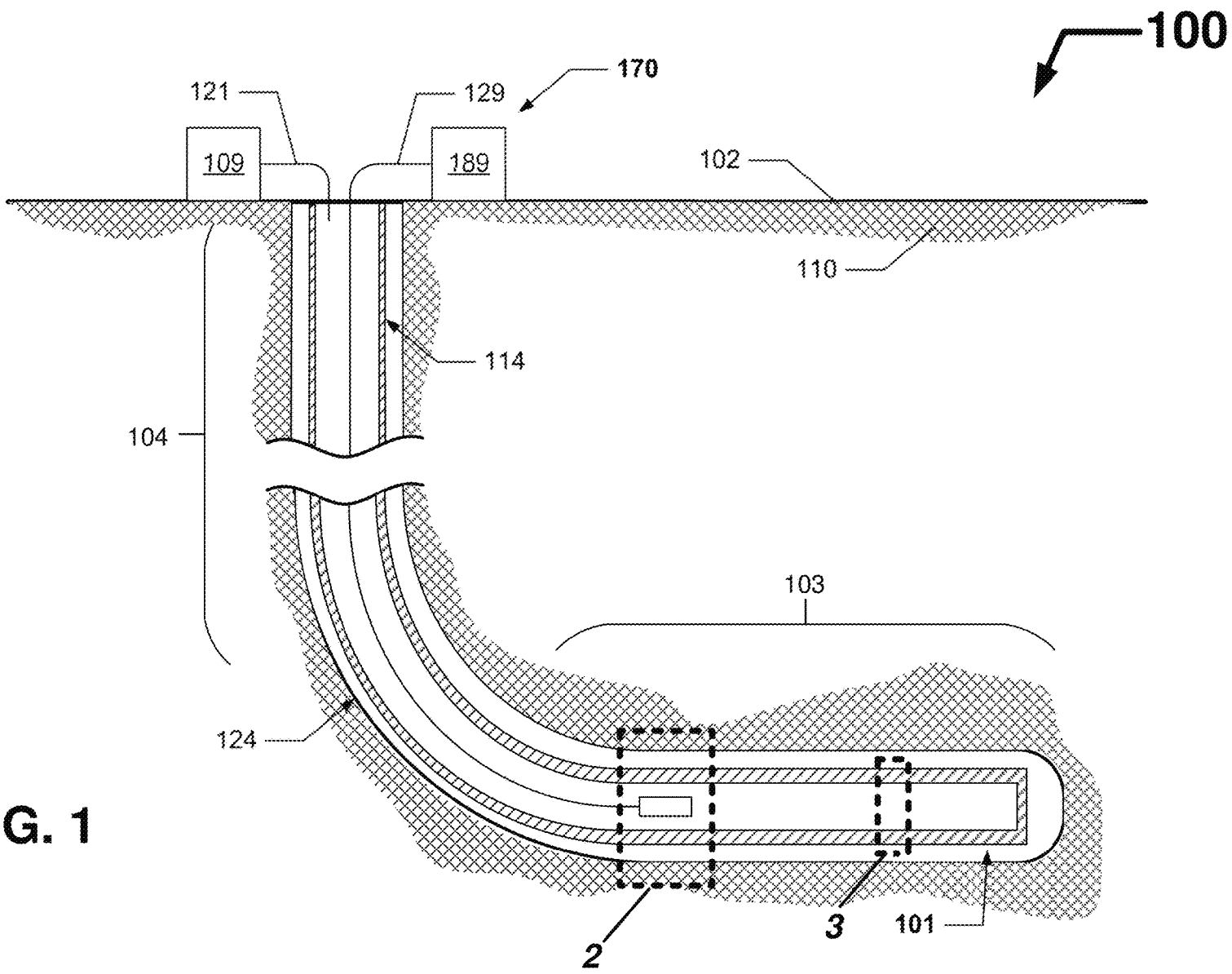
FIG. 1 shows a schematic diagram of a field system with a subterranean wellbore in which example embodiments may be used.

The example embodiments discussed herein are directed to systems, apparatus, methods, and devices for wireline conveyed casing test tool. Wireline conveyed casing test tool can be used in land-based or sea-based oil and gas projects. Example wireline conveyed casing test tool may be designed to comply with certain standards and/or requirements. In some cases, example embodiments may be applied to subterranean applications and uses not related to a wet shoe.

The use of the terms "about", "approximately", and similar terms applies to all numeric values, whether or not explicitly indicated. These terms generally refer to a range of numbers that one of ordinary skill in the art would consider as a reasonable amount of deviation to the recited numeric values (i.e., having the equivalent function or result). For example, this term may be construed as including a deviation of +10 percent of the given numeric value provided such a deviation does not alter the end function or result of the value. Therefore, a value of about 1% may be construed to be a range from 0.9% to 1.1%. Furthermore, a range may be construed to include the start and the end of the range. For example, a range of 10% to 20% (i.e., range of 10%-20%) includes 10% and also includes 20%, and includes percentages in between 10% and 20%, unless explicitly stated otherwise herein. Similarly, a range of between 10% and 20% (i.e., range between 10%-20%) includes 10% and also includes 20%, and includes percentages in between 10% and 20%, unless explicitly stated otherwise herein.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components. For example, in some embodiments, the item described by this phrase could include only a component of type A. In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C. In some embodiments, the item described by this phrase could include a component of type A, a component of type B, and a component of type C. In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C). In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

Example wireline conveyed casing test tools (including portions thereof) can be made of one or more of a number of suitable materials to allow the wet shoe sub and/or other components of a bottom hole assembly, tubing string, and/or other parts of a wellbore to meet certain standards and/or regulations while also maintaining durability in light of the one or more conditions under which the wireline conveyed casing test tools and/or other associated components of the wireline conveyed casing test tool can be exposed. Examples of such materials can include, but are not limited to, aluminum, stainless steel, fiberglass, glass, plastic, thermoplastic, ceramic, composite materials, and rubber.

When used in certain systems (e.g., for certain subsea field operations), example wireline conveyed casing test tools can be designed to comply with certain standards and/or requirements. Examples of entities that set such standards and/or requirements can include, but are not limited to, the Society of Petroleum Engineers, the American Petroleum Institute (API), the International Standards Organization (ISO), the International Association of Classification Societies (IACS), and the Occupational Safety and Health Administration (OSHA).

Example wireline conveyed casing test tools, or portions or components thereof, described herein can be made from a single piece (e.g., as from a mold, injection mold, casting, die cast, forging, extrusion process, or 3D printing). In addition, or in the alternative, example wireline conveyed casing test tools (including portions or components thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, snap fittings, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, abutting against, in communication with, or other similar terms. Such terms are merely meant to distinguish various elements and/or features within a component or device and are not meant to limit the capability or function of that particular element and/or feature. For example, a feature described as a "coupling feature" can couple, secure, fasten, abut against, and/or perform other functions aside from merely coupling.

A coupling feature (including a complementary coupling feature) as described herein can allow one or more components and/or portions of an example wireline conveyed casing test tool to become coupled, directly or indirectly, to some other component of a wireline tool assembly and/or a wet shoe sub. A coupling feature can include, but is not limited to, a clamp, a portion of a hinge, an aperture, a recessed area, a protrusion, a hole, a slot, a tab, a detent, and mating threads. One portion of an example wireline conveyed casing test tool can be coupled to some other component of a wireline tool assembly and/or a wet shoe sub by the direct use of one or more coupling features.

In addition, or in the alternative, a portion of an example wireline conveyed casing test tool can be coupled to another component of a wireline tool assembly and/or a wet shoe sub using one or more independent devices that interact with one or more coupling features disposed on a component of the example wireline conveyed casing test tool. Examples of such devices can include, but are not limited to, a pin, a hinge, a fastening device (e.g., a bolt, a screw, a rivet), epoxy, glue, adhesive, and a spring. One coupling feature described herein can be the same as, or different than, one or more other coupling features described herein. A complementary coupling feature as described herein can be a coupling feature that mechanically couples, directly or indirectly, with another coupling feature.

If a component of a figure is described but not expressly shown or labeled in that figure, the label used for a corresponding component in another figure may be inferred to that component. Conversely, if a component in a figure is labeled but is not described, the description for such component may be substantially the same as the description for the corresponding component in another figure. The numbering scheme for the various components in the figures herein is such that each component is a three-digit number or a four-digit number, and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of wireline conveyed casing test tools will be described more fully hereinafter with reference to the accompanying drawings, in which example embodiments of wireline conveyed casing test tools are shown. Wireline conveyed casing test tools may, however, be embodied in many different forms and should not be construed as limited to the example embodiments set forth herein. Rather, these example embodiments are provided so that this disclosure will be thorough and complete, and will fully convey the scope of wireline conveyed casing test tools to those of ordinary skill in the art. Like, but not necessarily the same, elements (also sometimes called components) in the various figures are denoted by like reference numerals for consistency.

Terms such as "first", "second", "primary," "secondary," "above", "below", "inner", "outer", "distal", "proximal", "end", "top", "bottom", "upper", "lower", "side", "width,", "height", "depth", "length", "left", "right", "front", "rear", and "within", when present, are used merely to distinguish one component (or part of a component or state of a component or orientation of a component) from another. This list of terms is not exclusive. Such terms are not meant to denote a preference or a particular orientation, and they are not meant to limit embodiments of wireline conveyed casing test tools. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 2:
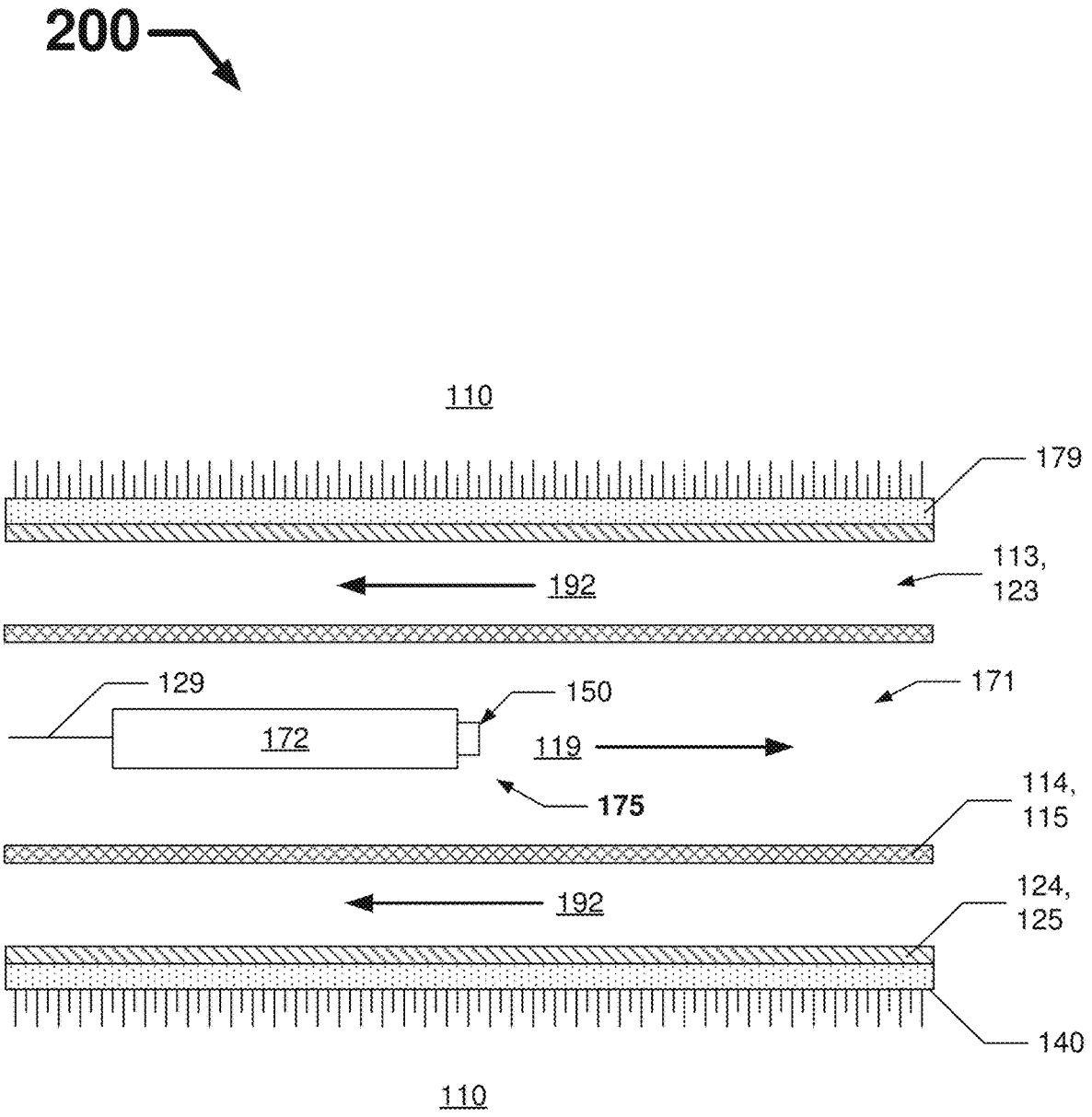
FIG. 2 shows a detailed sectional view of part of the horizontal section of the wellbore of the field system of FIG. 1 according to certain example embodiments.
Figure 3:
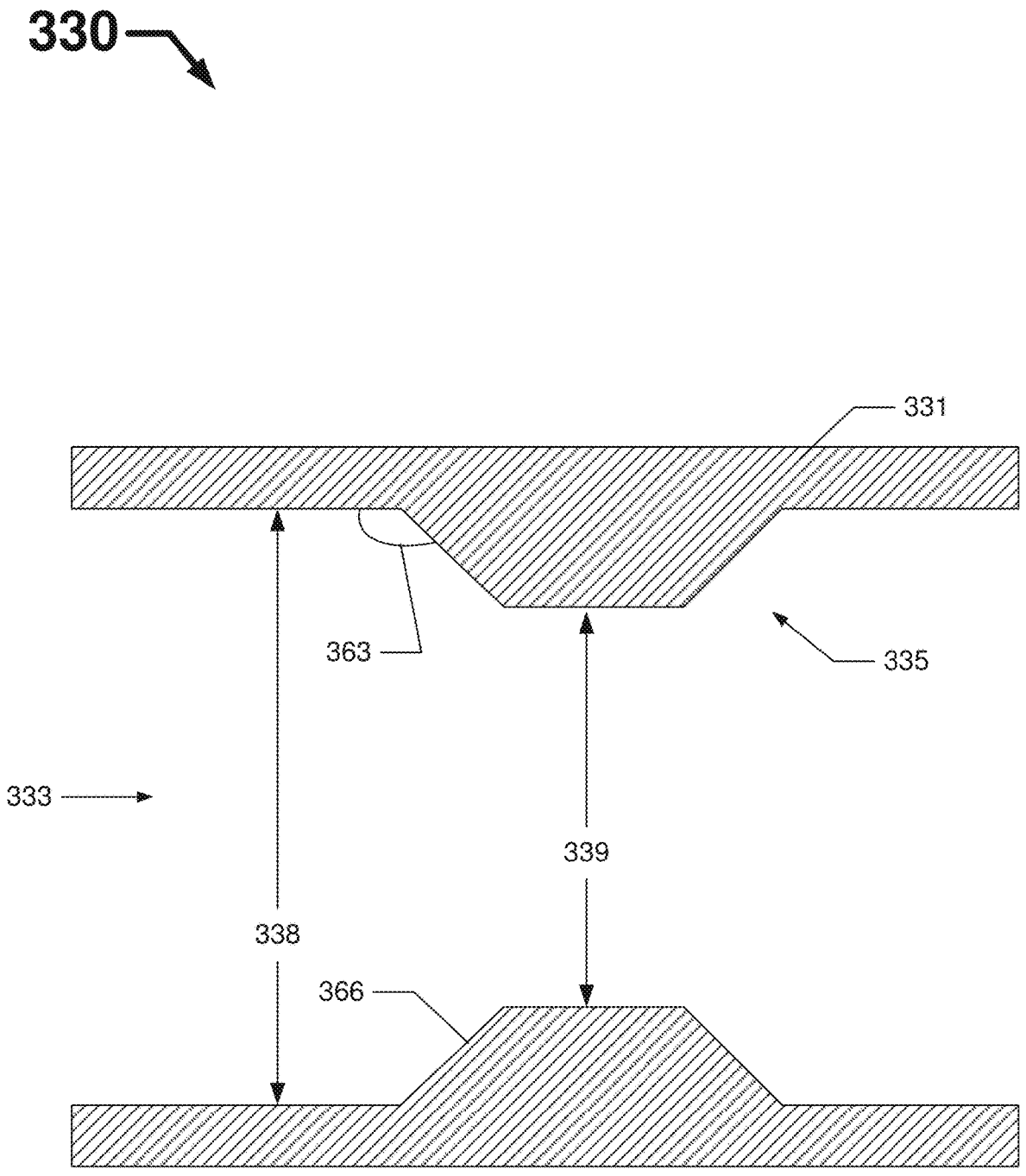
FIG. 3 shows a detailed sectional view of another part of the horizontal section of the wellbore of the field system of FIG. 1 according to certain example embodiments.

FIG. 1 shows a sectional view of a field system 100 with a subterranean wellbore 120 in which example embodiments may be used. FIG. 2 shows a detailed sectional view of part of the horizontal section 103 of the wellbore 120 of FIG. 1. FIG. 3 shows a detailed sectional view of another part of the horizontal section 103 of the wellbore 120 of FIG. 1. Referring to FIGS. 1 through 3, the wellbore 120 of the field system 100 in this example is bounded by a wall 140 in the subterranean formation 110 and formed using field equipment (discussed below). The surface 102 may be ground level for an on-shore application (as in this case) or the seabed for an off-shore application. The point where the wellbore 120 begins at the surface 102 may be called the entry point.

The subterranean formation 110 may include one or more of a number of formation types, including but not limited to shale, limestone, sandstone, clay, sand, and salt. In certain embodiments, some or all of the subterranean formation 110 may be unconventional as that term is known by those of ordinary skill in the art. For example, a subterranean formation 110 that is unconventional has a permeability and/or porosity that is so low that the subterranean resource 111 (e.g., oil, natural gas) cannot be extracted economically through a vertical section 104 of the wellbore 120 and instead requires a horizontal section 103 of the wellbore 120 that is subjected to fracturing operations. The subterranean formation 110 may include one or more reservoirs in which one or more subterranean resources (e.g., oil, gas, water, steam) may be located. One or more of a number of field operations (e.g., fracturing, coring, tripping, drilling, setting casing, cementing, production, wireline) may be performed using the field equipment to reach an objective of a user with respect to the subterranean formation 110.

The wellbore 120 may have one or more of a number of segments, where each segment may have one or more of a number of dimensions. Examples of such dimensions may include, but are not limited to, size (e.g., diameter) of the wellbore 120, a curvature of the wellbore 120, a true vertical depth of the wellbore 120, a measured depth of the wellbore 120, a vertical (or substantially vertical) section of the wellbore 120, a horizontal (or substantially horizontal) section of the wellbore 120, and a horizontal displacement of the wellbore 120. The field equipment may be used to create (e.g., drill) and/or develop (e.g., insert casing pipe, extract downhole materials) the wellbore 120. The field equipment may be positioned and/or assembled at the surface 102. The field equipment may include, but is not limited to, a wellbore circulation system 109 (including a circulation line 121), a derrick, a tool pusher, a clamp, a tong, drill pipe, a drill bit, mudlogging equipment, a power source, a tubing string 114, and a casing string 124.

The field equipment may also include one or more devices that measure and/or control various aspects (e.g., direction of wellbore 120, pressure, temperature) of a field operation associated with the wellbore 120. For example, the field equipment may include a wireline system 170 (e.g., including a wireline tool assembly 175, a wireline 129, and a wireline base 189) that is run through the wellbore 120 to provide detailed information (e.g., curvature, azimuth, inclination) throughout the wellbore 120. The wireline system 170 may also be used to implement one or more parts of a field operation. For example, the wireline system 170 may be used to deliver an example wireline conveyed casing test tool 150 within the wellbore 120. As another example, the wireline system 170 may be used to position a gun string within the wellbore 120.

Inserted into and disposed within the wellbore 120 of FIG. 1, and as detailed in FIG. 2, are a number of casing pipes 125 that are coupled to each other end-to-end to form the casing string 124. In this case, each end of a casing pipe 125 has mating threads (a type of coupling feature) disposed thereon, allowing a casing pipe 125 to be mechanically coupled to an adjacent casing pipe 125 in an end-to-end configuration. The casing pipes 125 of the casing string 124 may be mechanically coupled to each other directly or using a coupling device, such as a coupling sleeve. The casing string 124 is not disposed in the entire wellbore 120. Often, the casing string 124 is disposed from approximately the surface 102 to some other point in the wellbore 120. The open hole portion of the wellbore 120 extends beyond the casing string 124 at the distal end of the wellbore 120.

Each casing pipe 125 of the casing string 124 may have a length and a width (e.g., outer diameter). The length of a casing pipe 125 may vary. For example, a common length of a casing pipe 125 is approximately 40 feet. The length of a casing pipe 125 may be longer (e.g., 60 feet) or shorter (e.g., 10 feet) than 40 feet. The width of a casing pipe 125 may also vary and may depend on the cross-sectional shape of the casing pipe 125. For example, when the cross-sectional shape of the casing pipe 125 is circular, the width may refer to an outer diameter, an inner diameter, and/or some other form of measurement of the casing pipe 125. Examples of a width in terms of an outer diameter of a casing pipe 125 may include, but are not limited to, 7 inches, 7⅝ inches, 8⅝ inches, 9⅝ inches, 9⅞ inches, 10¾ inches, 13⅜ inches, and 14 inches.

The size (e.g., width, length) of the casing string 124 may be based on the information gathered using field equipment with respect to the wellbore 120. The walls of the casing string 124 have an inner surface that forms a cavity 113 that traverses the length of the casing string 124. (When the tubing string 114 is positioned inside the casing string, the cavity 113 is redefined as the annulus 123 for the space between the tubing string 114 and the casing string 124.) Each casing pipe 125 may be made of one or more of a number of suitable materials, including but not limited to stainless steel. After the casing string 124 (or a portion thereof) is set, cement 179 is poured into the wellbore 120 (e.g., through the cavity 113 and then forced upward between the outer surface of the casing string 124 and the wall 140 of the subterranean wellbore 120) to adhere the casing string 124 to the wall 140. In some cases, a liner may additionally be used with, or alternatively be used in place of, some or all of the casing pipes 125.

A number of tubing pipes 115 that are coupled to each other and inserted into the wellbore 120 form the tubing string 114. The tubing string 114 may be positioned inside the cavity 113 of the casing sting 124. The tubing pipes 115 of the tubing string 114 are mechanically coupled to each other end-to-end, usually with mating threads (a type of coupling feature). The tubing pipes 115 of the tubing string 114 may be mechanically coupled to each other directly or indirectly using a coupling device, such as a coupling sleeve.

Each tubing pipe 115 of the tubing string 114 may have a length and a width (e.g., outer diameter). The length of a tubing pipe 115 may vary. For example, a common length of a tubing pipe 115 is approximately 30 feet. The length of a tubing pipe 115 may be longer (e.g., 40 feet) or shorter (e.g., 10 feet) than 30 feet. Also, the length of a tubing pipe 115 may be the same as, or different than, the length of an adjacent casing pipe 125. The width of a tubing pipe 115 may also vary and may depend on one or more of a number of factors, including but not limited to the target depth of the wellbore 120, the total length of the wellbore 120, the inner diameter of the adjacent casing pipe 125, and the curvature of the wellbore 120.

The width of a tubing pipe 115 may refer to an outer diameter, an inner diameter, and/or some other form of measurement of the tubing pipe 115. Examples of a width in terms of an outer diameter for a tubing pipe 115 may include, but are not limited to, 7 inches, 5 inches, and 4 inches. The outer diameter of the tubing pipe 115 may be less than the inner diameter of the casing pipe 125, resulting in a gap 123 (also called an annulus 123) between the tubing pipe 115 and the adjacent casing pipe 125. The walls of the tubing pipe 115 have an inner surface that forms a cavity 171 that traverses the length of the tubing pipe 115. The tubing pipe 115 may be made of one or more of a number of suitable materials, including but not limited to steel.

At the distal end of the tubing string 114 within the wellbore 120 is a BHA 101. The BHA 101 may include one or more of a number of components that may vary over time, depending on the particular field operation (or portion thereof) being performed. Examples of components of the BHA 101 may include, but are not limited to, a wet shoe sub 330, a drill bit, a measurement-while-drilling (MWD) tool, one or more collars, one or more subs, and one or more stabilizers. During a field operation, the tubing string 114, including the BHA 101, may be inserted and/or rotated by other field equipment. The tubing string 114, BHA 101, and any other pieces of field equipment coupled to one or more of these components may generally be referred to herein as a downhole assembly or a wellbore assembly.

In some cases, as during a fracturing operation, a specialized tool (e.g., the wet shoe sub 330, also sometimes called a wet shoe activation sub 330) may be integrated with or placed above the BHA 101 as part of the tubing string 114. When different field operations are undertaken in the wellbore 120, the wellbore assembly (or portions thereof, such as the BHA 101) may be removed (i.e., brought to the surface 102 or tripped out) and reassembled with different field equipment and/or in a different arrangement.

The wellbore circulation system 109 may include one or more of a number of components that allow a user to control the one or more downhole components (e.g., a portion of the BHA 101) from the surface 102. The wellbore circulation system 109 may also include one or more of a number of components that allow a working fluid 119 (e.g., drilling fluid, fracturing fluid, water) to flow from the surface 102 down the cavity 171 of the tubing string 114, out the BHA 101, and up the annulus 123 between the tubing string 114 and the casing string 124, as shown in FIG. 2. Examples of such components of the wellbore circulation system 109 may include, but are not limited to, a compressor, a valve, a pump, piping, and a motor.

When the working fluid 119 reaches the end of the wellbore 120, a return fluid 192 travels up the annulus 123 to the surface 102. The return fluid 192 includes the working fluid 119 mixed with other components (e.g., rock cuttings, subterranean resources (e.g., oil, natural gas), gases, formation water) that reach the wellbore 120 from the subterranean formation 110. In some cases, when the field equipment includes mudlogging equipment, the mudlogging equipment may take a sample of the return fluid 192 to analyze one or more of the other components (e.g., determine the type and/or quantity of subterranean formation 110 and/or subterranean resources 111 at a particular depth of the wellbore 120) of the return fluid 192 that were not present in the working fluid 119. For example, the mudlogging equipment may include a gas trap or gas extractor that may extract, measure, and analyze some of the gases dissolved in the return fluid 192.

The working fluid 119 may include one or more of a number of components. Such components of the working fluid 119 may include, but are not limited to, one or more clays, one or more chemical additives (e.g., an acid, a chelant), an oil base, and a water base. Pumping the working fluid 119 downhole through the cavity 171 of the tubing string 114 may serve one or more of a number of purposes. Such purposes may include, but are not limited to, controlling formation pressure at the wellbore 120; cleaning the wellbore 120 of formation debris; lubricating, cleaning, and cooling some or all of the BHA 101 and/or the tubing string 114; stabilizing the wellbore 120; and limiting the loss of working fluid 119 to the subterranean formation 110.

While not shown in FIG. 1, there may be multiple wellbores 120, each with its own wellhead but that is located close to the other wellheads, drilled into the subterranean formation 110 and having substantially horizontal sections 103 that are close to each other. In such a case, the multiple wellbores 120 may be drilled at the same pad or at different pads. When the drilling process is complete, other operations, such as fracturing operations and production operations, may be performed. A fracturing operation may enhance existing fractures in the subterranean formation 110 and/or create new fractures in the subterranean formation 110.

Fractures in the subterranean formation 110 may be naturally-occurring or induced. For production purposes, a user may need fractures in the horizontal section 103 of the wellbore 120 in FIG. 1. The fractures, whether induced and/or naturally occurring, may additionally or alternatively be located in other sections (e.g., the vertical section 104, a transition area between the vertical section 104 and the horizontal section 103) of the wellbore 120. The fractures provide paths for formation water, gases, subterranean resources, and/or any other components in the subterranean formation 110 to enter the wellbore 120.

Operations that induce fractures in the subterranean formation 110 use any of a number of fluids that include proppant (e.g., sand, ceramic pellets). When proppant is used, some of the fractures (also sometimes called principal or primary fractures) receive proppant, while a remainder of the fractures (also sometimes called secondary fractures) do not have any proppant in them. When proppant is used, the proppant is designed to become lodged inside at least some of the induced fractures to keep those fractures open after the fracturing operation is complete. The sizes and/or shapes of the proppant may vary.

The use of proppant in certain types of subterranean formation 110, such as shale and other tight (unconventional) formations, may be important. For example, the rock matrix of shale formations typically have permeabilities on the order of microdarcys (μD) to nanodarcys (nD). When fractures are induced in such formations with low permeabilities, it is important to sustain the fractures and their conductivity for an extended period of time in order to extract more of the subterranean resources.

The induced fractures create a volume within the subterranean formation 110 where the rock matrix of the subterranean formation 110 is connected to the high conductivity fractures located a short distance away. In addition to different configurations of the fractures, other factors that may contribute to the viability of the subterranean formation 110 may include, but are not limited to, permeability of the rock matrix, capillary pressure, and the temperature and pressure of the subterranean formation 110. Each fracture, whether induced or naturally occurring, is defined by a wall, also called a frac face. The frac face provides a transition between the paths formed by the rock matrices in the subterranean formation 110 and the fracture. The subterranean resources 111 flow through the paths formed by the rock matrices in the subterranean formation 110 into the fracture, and then on to the wellbore 120.

At the point in time captured in FIGS. 1 through 3, a wireline operation is being performed using the wireline system 170. Specifically, the wireline base 189 of the wireline system 170 lowers the wireline 129 and the wireline tool assembly 175 of the wireline system 170 into the wellbore 120 through the cavity 171 of the tubing string 114 into the horizontal section 103 of the wellbore 120. The wireline tool assembly 175 is located at the end of the wireline 129. The wireline tool assembly 175 can include one or more of a number of components. For example, in this case, the wireline tool assembly 175 includes a wireline tool 172 and an example wireline conveyed casing test tool 150. Another example of a component of the wireline tool assembly 175 may be a gun string. In this way, the wireline tool 12 conveys the wireline conveyed casing test tool 150 to the horizontal section 103 of the wellbore 120. The diameter of the wireline tool assembly 175, including the diameter of its various components (e.g., the wireline conveyed casing test tool 150), is less than the diameter of the tubing string 114.

The example wireline conveyed casing test tool 150 of the wireline tool assembly 175 is detachably coupled to the wireline tool 172 of the wireline tool assembly 175. The wireline conveyed casing test tool 150 is configured to be released from the wireline tool 172 when the wireline tool assembly 175 is positioned within the horizontal section 103 of the wellbore 120. Once released, the wireline conveyed casing test tool 150 is carried by working fluid 119 flowing in the cavity 171 of the tubing string 114 toward the seat 335 of the wet shoe sub 330. When the wireline conveyed casing test tool 150 abuts against the seat 335 of the wet shoe sub 330, the wireline conveyed casing test tool 150 forms a seal with the seat 335 of the wet shoe sub 330. The example wireline conveyed casing test tool 150 may be called by any of a number of other names, including a dart, a ball, and a plug. More information about the example wireline conveyed casing test tool 150 is provided below with respect to FIGS. 4A through 7.

The wet shoe sub 330, as detailed in FIG. 3, is part of the BHA 101 of the tubing string 114. The wet shoe sub 330 has a body 331 that forms a cavity 333, where the body 331 of the wet shoe sub 330 is continuous with the rest of the tubing string 114 and where the cavity 333 of the wet shoe sub 330 is continuous with the cavity 117 of the rest of the tubing string 114. Most of the body 331 of the wet shoe sub 330 forms a diameter 338 (also sometimes referred to herein as a cavity diameter 338) that is substantially the same as the diameter of the rest of the tubing string 114.

Part of the body 331 of the wet shoe sub 330 includes a seat 335 that protrudes inward. The seat 335 has a diameter 339 (also sometimes referred to herein as a seat diameter 339) that is less than the diameter 338 of the rest of the body 331 of the wet shoe sub 330. The seat 335 can have any of a number of shapes and/or sizes. In this case, the seat 335 is sloped at the front and back and has a middle section that is substantially parallel to the rest of the body 331. The slope 366 in this case forms an obtuse angle 363 (also sometimes called a seat angle 363 herein) with the inner surface of the wall of the body 331. Those of ordinary skill in the art may recognize that the seat 335 of the wet shoe sub 330 may have any of a number of other configurations (e.g., any angle 363, and diameter 339 of the seat 335).

In alternative embodiments, rather than a wet shoe test sub, the sub 330 may have some other form or purpose while still having a seat 335. For example, a toe port or toe sleeve system may be part of the sub 330 for purposes of being used with example embodiments. Such systems allow for achieving a casing test. Regardless of the precise configuration and/or location of the sub 330, the example wireline conveyed casing test tool 450 is designed to form and maintain a seal with the seat 335 of the sub 330.

Figure 4A:
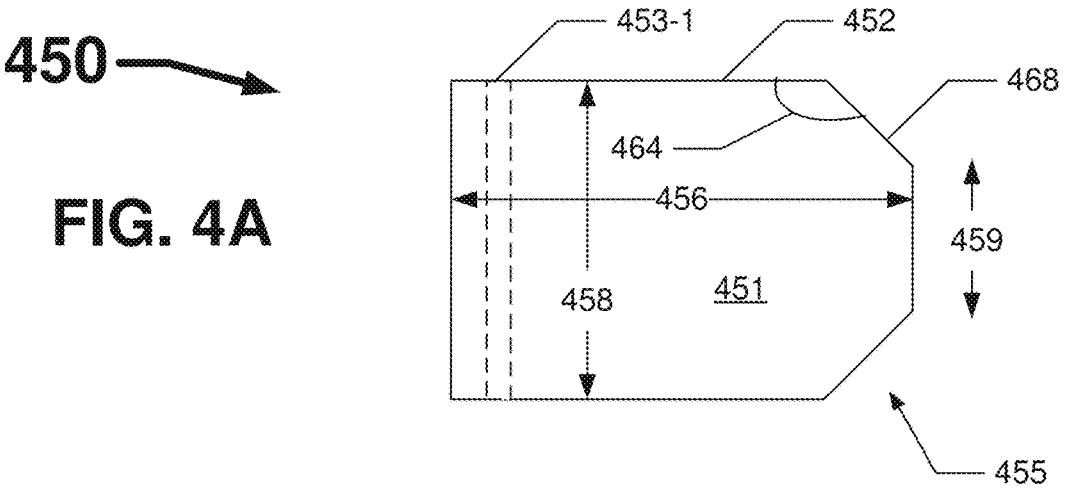
FIGS. 4A through 4C show various views of a wireline conveyed casing test tool according to certain example embodiments.
Figure 4B:
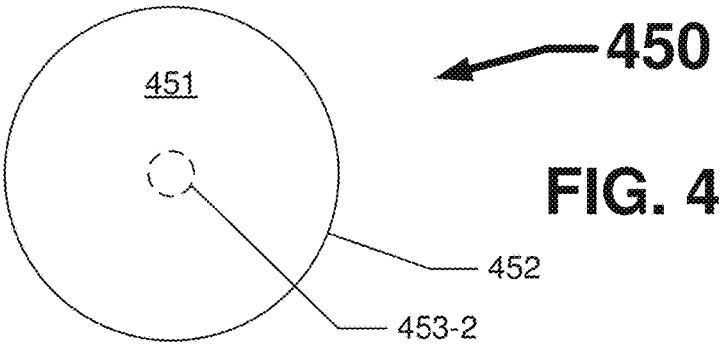
Figure 4C:
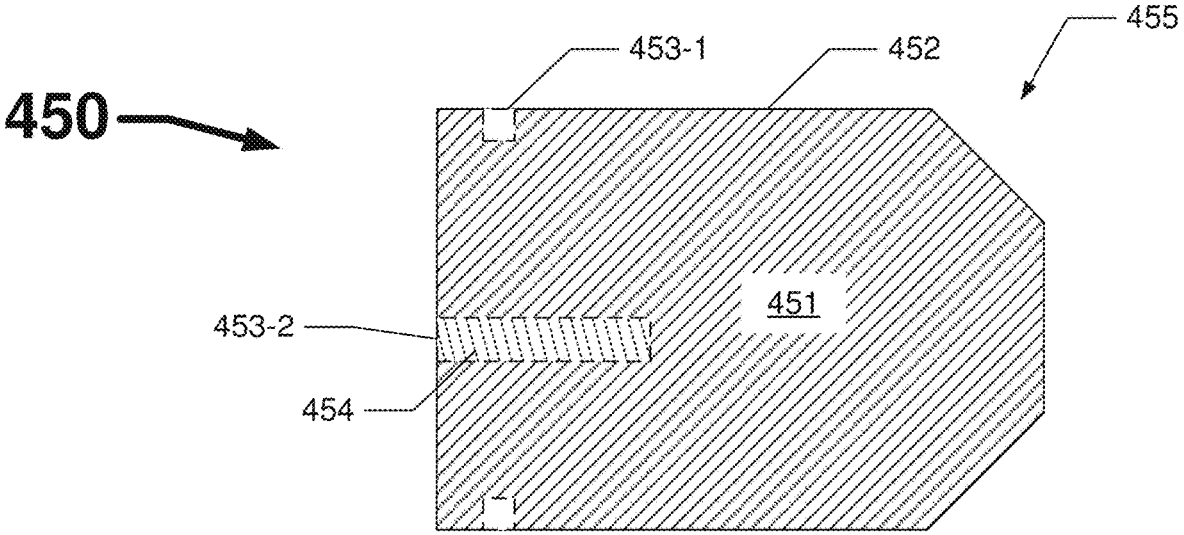

FIGS. 4A through 4C show various views of a wireline conveyed casing test tool 450 according to certain example embodiments. Specifically, FIG. 4A shows a side view of the wireline conveyed casing test tool 450. FIG. 4B shows a rear view of the wireline conveyed casing test tool 450. FIG. 4C shows a sectional side view of the wireline conveyed casing test tool 450. Referring to the description above with respect to FIGS. 1 through 3, the wireline conveyed casing test tool 450 of FIGS. 4A through 4C is an example of the wireline conveyed casing test tool 150 discussed above with respect to FIGS. 1 through 3. In this case, the wireline conveyed casing test tool 450 includes a body 451 having a diameter 458 (also sometimes referred to herein as the maximum diameter 458), an overall length 456, and a distal end 455. The body 451 of the wireline conveyed casing test tool 450 may be made of one or more of any of a number of materials (e.g., a metal, a composite). In certain example embodiments, the body 451 of the wireline conveyed casing test tool 450 is made of a material that is non-dissolvable. The body 451 of the wireline conveyed casing test tool 450 may be configured to withstand pressures (e.g., in excess of 5000 psia, in excess of 9800 psia), temperatures (e.g., in excess of 200° F., in excess of 500° F.), and/or other conditions that may exist toward the distal end of the wellbore (e.g., wellbore 120) for an extended period of time (e.g., 2 weeks, one month).

The distal end 455 is configured to abut against the seat 335 of the wet shoe sub 330 to create a seal with the seat 335 of the wet shoe sub 330. As such, the distal end 455 of the wireline conveyed casing test tool 450 may have any of a number of configurations. For example, in this case, the distal end 455 of the wireline conveyed casing test tool 450 has a graduated diameter. Specifically, the most distal surface of the distal end is substantially vertical and has a diameter 459 that is less than the diameter 458 of the remainder of the body 451 of the wireline conveyed casing test tool 450. From the most distal surface, the diameter gradually and linearly increases until it reaches the diameter 458, which is defined by the outer surface 452 of the body 451 of the wireline conveyed casing test tool 450.

In certain example embodiments, the maximum diameter 458 may be configured to be larger than the seat diameter 339 of the seat 335 of the wet shoe sub 330. In addition, the maximum diameter 458 may be configured to be smaller than the cavity diameter 338 of the wet shoe sub 330. In some cases, the distal end 455 of the wireline conveyed casing test tool 450 may be configured to complement the seat 335 of the wet shoe sub 330 so that the distal end 455 of the wireline conveyed casing test tool 450 is configured to form a seal with the seat 335 of the wet shoe sub 330 when the distal end 455 of the wireline conveyed casing test tool 450 abuts against the seat 335 of the wet shoe sub 330. The overall length 456 of the body 451 may be configured to be greater than the maximum diameter 458 (e.g., 3.5 inches) of the body 451 and also greater than the cavity diameter 338 of the wet shoe sub 330. In this way, the wireline conveyed casing test tool 450 may not change its horizontal orientation within the cavity 171 of the tubing string 114, resulting in the distal end 455 of the wireline conveyed casing test tool 450 always being closest to the distal end of the wellbore 120. In certain example embodiments, the various dimensions (e.g., the maximum diameter 458, the overall length 456) of the body 451 of the wireline conveyed casing test tool 450 are not meant to change substantially over time. For example, in some cases, the body 451 of the wireline conveyed casing test tool 450 may not have any expansion or retraction capabilities (e.g., no slips or other similar elements).

To form the seal with seat 335 of the wet shoe sub 330, the contours of the distal end 455 of the wireline conveyed casing test tool 450 may substantially complement the contours of the seat 335 of the wet shoe sub 330. For example, in this case, the slope 468 forms an obtuse angle 464 (e.g., 105°, 135°) with the outer surface of the side wall of the distal end 455 of the wireline conveyed casing test tool 450. The angle 464 (also sometimes called a tool angle 464 herein) formed by the slope 468 of the wireline conveyed casing test tool 450 may be substantially the same as the angle 363 (e.g., 135°, 150°) formed by the slope 366 of the seat 335 of the wet shoe sub 330. In other cases, the distal end 455 of the wireline conveyed casing test tool 450 may be configured in such a way that the contours (e.g., the angle 464) of the distal end 455 of the wireline conveyed casing test tool 450 do not substantially complement the contours (e.g., the angle 363) of the seat 335 of the wet shoe sub 330, and yet the distal end 455 of the wireline conveyed casing test tool 450 still forms a seal with the seat 335 of the wet shoe sub 330 when the distal end 455 of the wireline conveyed casing test tool 450 abuts against the seat 335 of the wet shoe sub 330.

In certain example embodiments, the wireline conveyed casing test tool 450 may include one or more optional coupling features 453 at or near its proximal end. Such a coupling feature may be configured to receive a complementary coupling feature of a wireline tool (e.g., wireline tool 172) to secure the wireline conveyed casing test tool 450 when the wireline tool assembly (e.g., wireline tool assembly 175) is lowered into the wellbore (e.g., wellbore 120), to retrieve the wireline conveyed casing test tool 450 within the wellbore, and/or to secure the wireline conveyed casing test tool 450 when the wireline assembly is extracted from the wellbore.

For example, as shown in FIGS. 4A and 4C, the wireline conveyed casing test tool 450 includes an optional coupling feature 453-1 in the form of a recessed 6 channel in the body 451 toward the proximal end of the body 451 that is continuous around the outer perimeter of the body 451. As another example, as shown in FIGS. 4B and 4C, the wireline conveyed casing test tool 450 includes another optional coupling feature 453-2 in the form of a hole in the proximal surface of the body 451, where the hole is bounded by mating threads 454. Those of ordinary skill in the art will appreciate that such coupling features 453 of the wireline conveyed casing test tool 450 may have any of a number of other forms and/or configurations.

Figure 5:
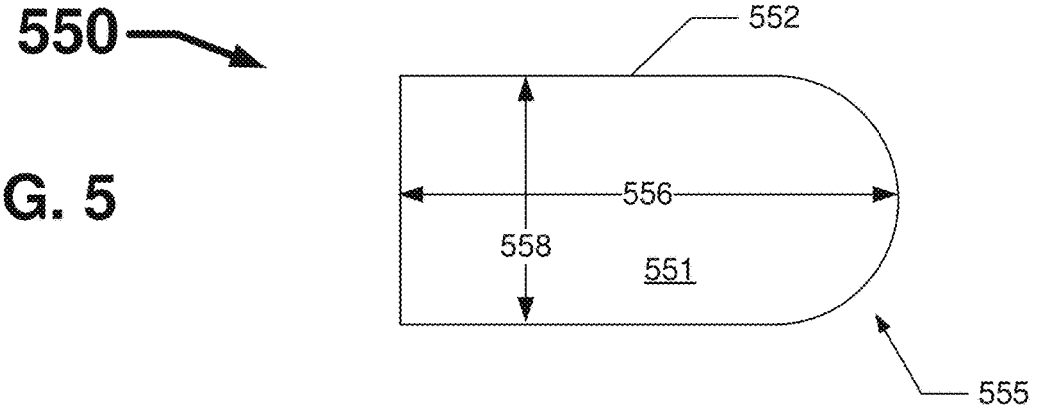
FIGS. 5 through 7 show other wireline conveyed casing test tool according to certain example embodiments.
Figure 6:
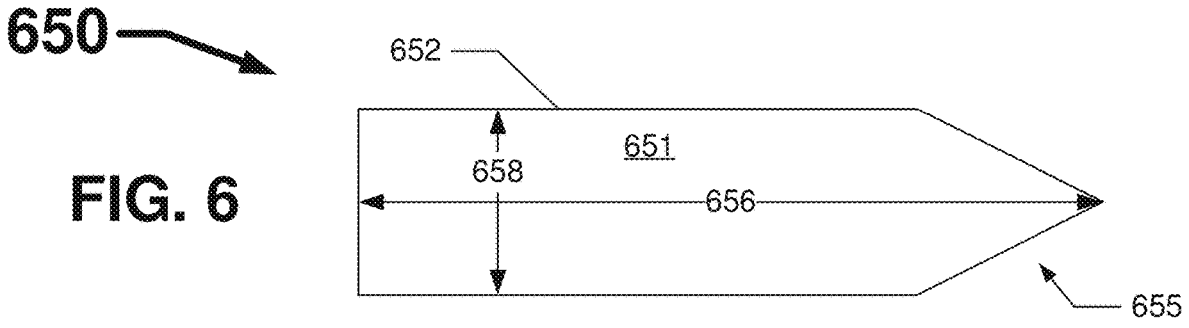
Figure 7:
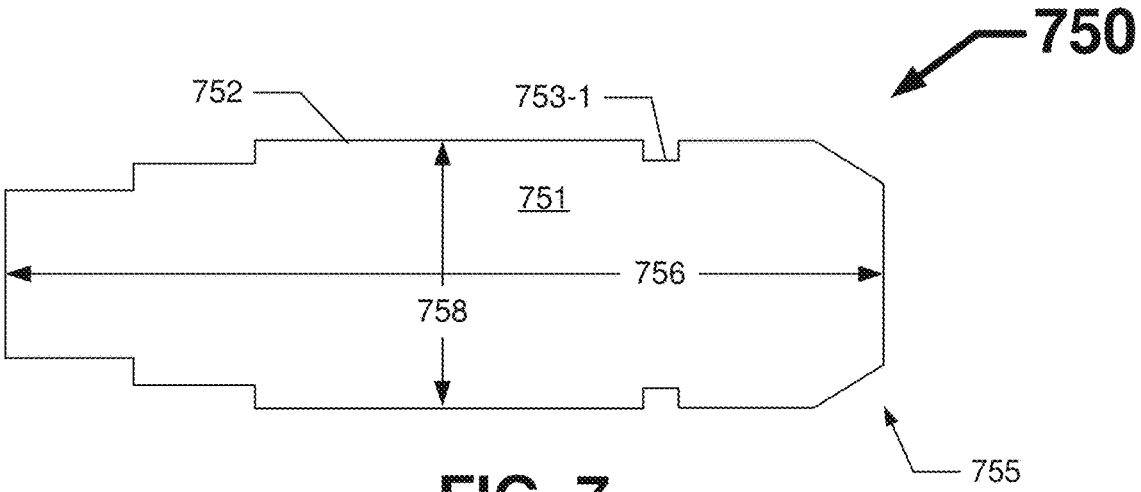

FIGS. 5 through 7 show other wireline conveyed casing test tool according to certain example embodiments. Referring to the description above with respect to FIGS. 1 through 4C, the wireline conveyed casing test tools of FIGS. 5 through 7 are examples of the wireline conveyed casing test tool 150 discussed above with respect to FIGS. 1 through 3. In this case, the wireline conveyed casing test tool 550 of FIG. 5 includes a body 551 having a maximum diameter 558 that is defined by the outer surface 552 of the body 551. The overall length 556 of the body 551 in this case is greater than the maximum diameter 558 of the body 551 and is also greater than the cavity diameter 338 of the wet shoe sub 330. In this way, the wireline conveyed casing test tool 550 may not change its horizontal orientation within the cavity 171 of the tubing string 114, resulting in the distal end 555 of the wireline conveyed casing test tool 550 always being closest to the distal end of the wellbore 120. The distal end 555 of the body 551 in this case has a semi-spherical shape.

The wireline conveyed casing test tool 650 of FIG. 6 includes a body 651 having a maximum diameter 658 that is defined by the outer surface 652 of the body 651. The overall length 656 of the body 651 in this case is greater than the maximum diameter 658 of the body 651 and is also greater than the cavity diameter 338 of the wet shoe sub 330. In this way, the wireline conveyed casing test tool 650 may not change its horizontal orientation within the cavity 171 of the tubing string 114, resulting in the distal end 655 of the wireline conveyed casing test tool 650 always being closest to the distal end of the wellbore 120. The distal end 655 of the body 651 in this case has a conical shape.

The wireline conveyed casing test tool 750 of FIG. 7 includes a body 751 having a maximum diameter 758 that is defined by the outer surface 752 of the body 751. The overall length 756 of the body 751 in this case is greater than the maximum diameter 758 of the body 751 and is also greater than the cavity diameter 338 of the wet shoe sub 330. In this way, the wireline conveyed casing test tool 750 may not change its horizontal orientation within the cavity 171 of the tubing string 114, resulting in the distal end 755 of the wireline conveyed casing test tool 750 always being closest to the distal end of the wellbore 120. The body 751 also includes a coupling feature 753 in the form of a channel that traverses the entire outer perimeter of the body 751 toward the distal end 755. The coupling feature 753 may be used to receive, for example, a sealing device (e.g., a gasket, an O-ring) or a pump down ring. The distal end 755 of the body 751 is shaped substantially the same as the distal end 455 of the body 451 of the wireline conveyed casing test tool 450 of FIGS. 4A through 4C.

In some alternative embodiments, the body of an example wireline conveyed casing test tool is a sphere, and so the overall length of the body is substantially equal to the maximum diameter of the body. In such cases, both the maximum diameter and the overall length of the body are less than the cavity diameter 338 of the wet shoe sub 330. In this way, the wireline conveyed casing test tool may change its horizontal orientation within the cavity 171 of the tubing string 114, and so any end of the body that is closest to the distal end of the wellbore 120 is the distal end.

Figure 8:
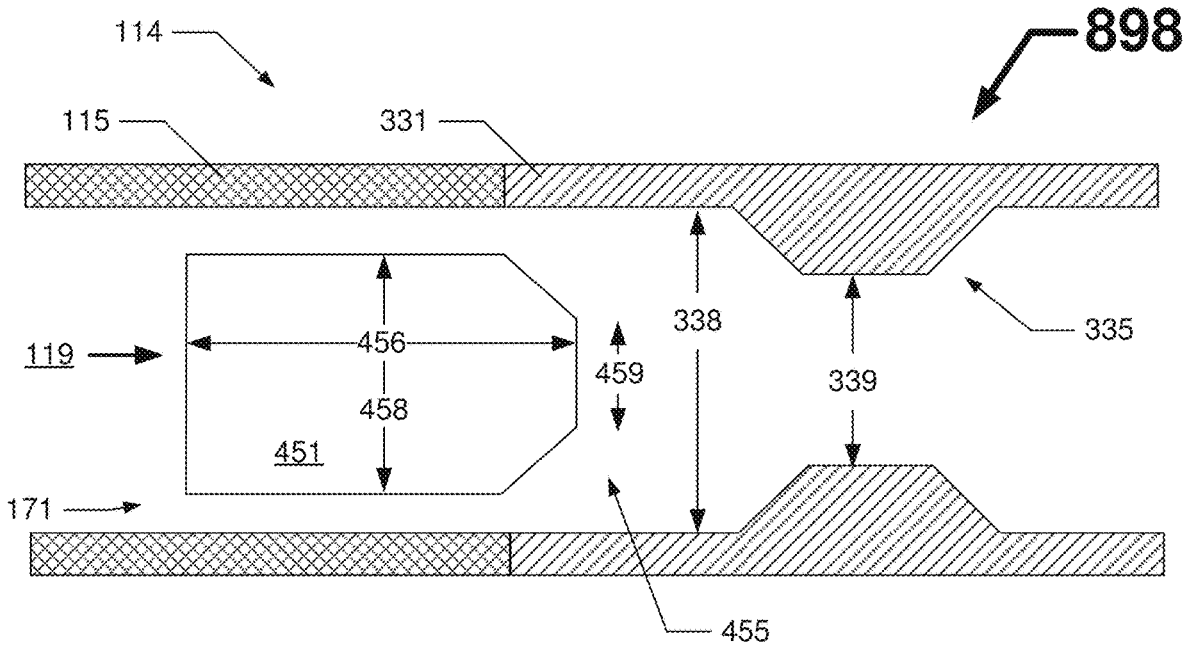
FIGS. 8 and 9 show a subsystem displaying the interaction between the wireline conveyed casing test tool of FIGS. 4A through 4C and the wet shoe sub of FIG. 3 according to certain example embodiments.
Figure 9:
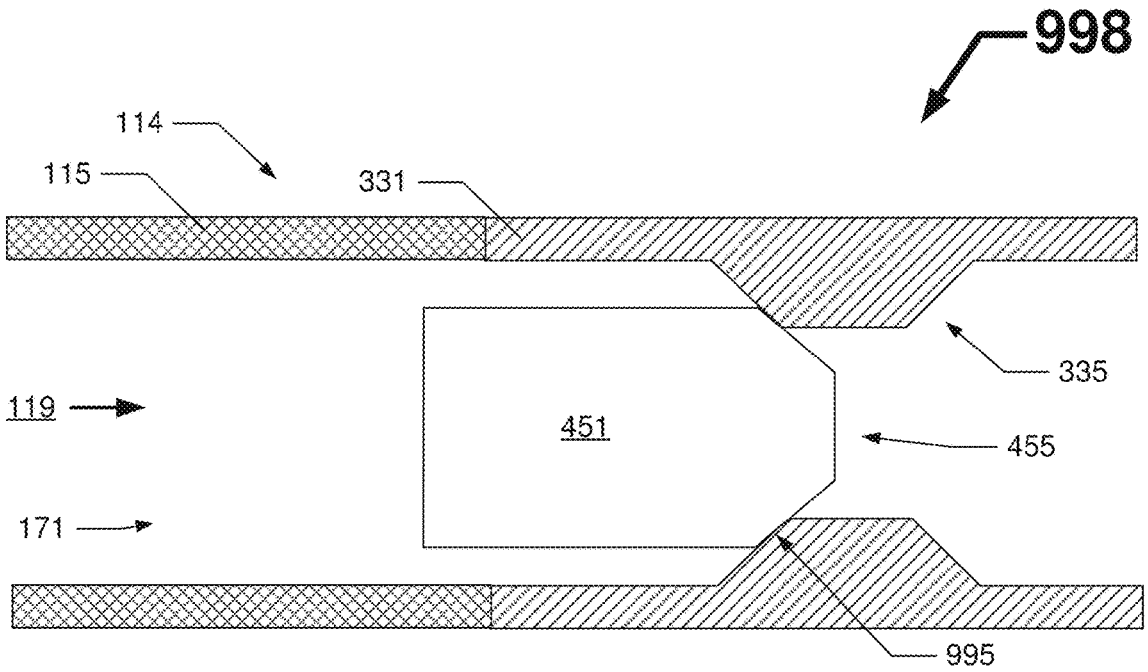

FIGS. 8 and 9 show a subsystem 898 displaying the interaction between the wireline conveyed casing test tool 450 of FIGS. 4A through 4C and the wet shoe sub of FIG. 3 according to certain example embodiments. Specifically, FIG. 8 shows the subsystem 898 before the wireline conveyed casing test tool 450 abuts against the seat 335 of the wet shoe sub 330, and FIG. 9 shows the subsystem 998 after the wireline conveyed casing test tool 450 abuts against the seat 335 of the wet shoe sub 330. Referring to the description above with respect to FIGS. 1 through 7, the subsystem 898 of FIG. 8 and the subsystem 998 of FIG. 9 include the wet shoe sub 330 coupled to a tubing pipe 115, where collectively the wet shoe sub 330 and the tubing pipe 115 are part of the tubing string 114. The wet shoe sub 330 is downstream of the tubing pipe 115. Also, working fluid 119 is flowing downstream within the cavity 171 of the tubing string 114. The working fluid 119 may be pumped into the cavity 171 of the tubing string 114 using the wellbore circulation system 109.

At the point in time captured in FIG. 8, the wireline conveyed casing test tool 450 has already been delivered to the horizontal section (e.g., horizontal section 103) of the wellbore (e.g., wellbore 120) by the remainder of the wireline tool assembly 175 and released by the wireline tool 172. The working fluid 119 is carrying the wireline conveyed casing test tool 450 downstream within the cavity 171 of the tubing string 114 toward the seat 335 of the wet shoe sub 330. The diameter 459 of the distal surface of the distal end 455 of the wireline conveyed casing test tool 450 is less than the seat diameter 339 of the seat 335 of the wet shoe sub 330, which is less than the maximum diameter 338 of the body 331 of the wireline conveyed casing test tool 450, which is less than the cavity diameter 338 of the body 331 of the wet shoe sub 330, which is less than the overall length 456 of the body 451 of the wireline conveyed casing test tool 450. In this way, the distal end 455 of the wireline conveyed casing test tool 450 is ensured to be the first part of the wireline conveyed casing test tool 450 to contact the seat 335 of the wet shoe sub 330.

At the point in time captured in FIG. 9, subsequent to the point in time captured in FIG. 8, the working fluid 119 has carried the wireline conveyed casing test tool 450 further downstream within the cavity 171 of the tubing string 114 so that the distal end 455 of the wireline conveyed casing test tool 450 abuts against the seat 335 of the wet shoe sub 330. The working fluid 119 remains under pressure so that the distal end 455 of the wireline conveyed casing test tool 450 maintains a seal 995 with the seat 335 of the wet shoe sub 330.

Figure 10:
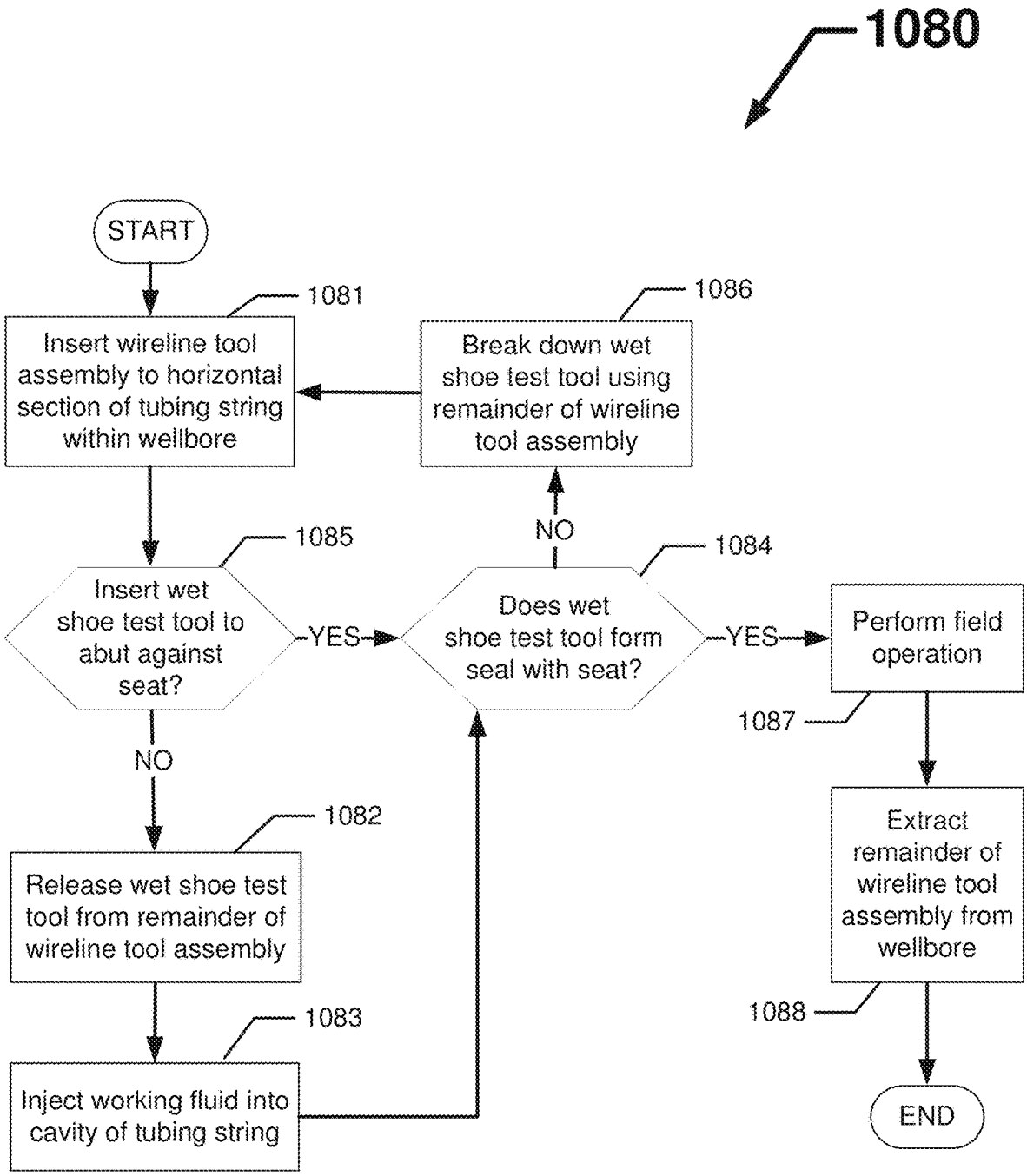
FIG. 10 shows a flowchart of a method for isolating a wet shoe in a horizontal section of a wellbore according to certain example embodiments.

FIG. 10 shows a flowchart 1080 of a method for isolating a wet shoe sub 330 in a horizontal section 103 of a wellbore 120 according to certain example embodiments. While the various steps in this flowchart 1080 are presented sequentially, one of ordinary skill will appreciate that some or all of the steps may be executed in different orders, may be combined or omitted, and some or all of the steps may be executed in parallel. Further, in one or more of the example embodiments, one or more of the steps shown in this example method may be omitted, repeated, and/or performed in a different order.

In addition, a person of ordinary skill in the art will appreciate that additional steps not shown in FIG. 10 may be included in performing this method. Accordingly, the specific arrangement of steps should not be construed as limiting the scope. Any of the functions in the method may be performed by or using a controller (e.g., using a non-transitory computer readable medium). In addition, or in the alternative, any of the functions in the method may be performed by a user, which may include but is not limited to a business owner, an engineer, a company representative, a geologist, a consultant, a chemist, a drilling engineer, a contractor, and a manufacturer's representative. The method shown in FIG. 10 is merely an example that may be performed by using an example system described herein. In other words, systems for isolating a wet shoe sub 330 in a horizontal section 103 of a wellbore (e.g., wellbore 120) may perform other functions using other methods in addition to and/or aside from those shown in FIG. 10. In addition, FIGS. 11 through 18 show various steps of the method captured in the flowchart 1080.

Figure 11:
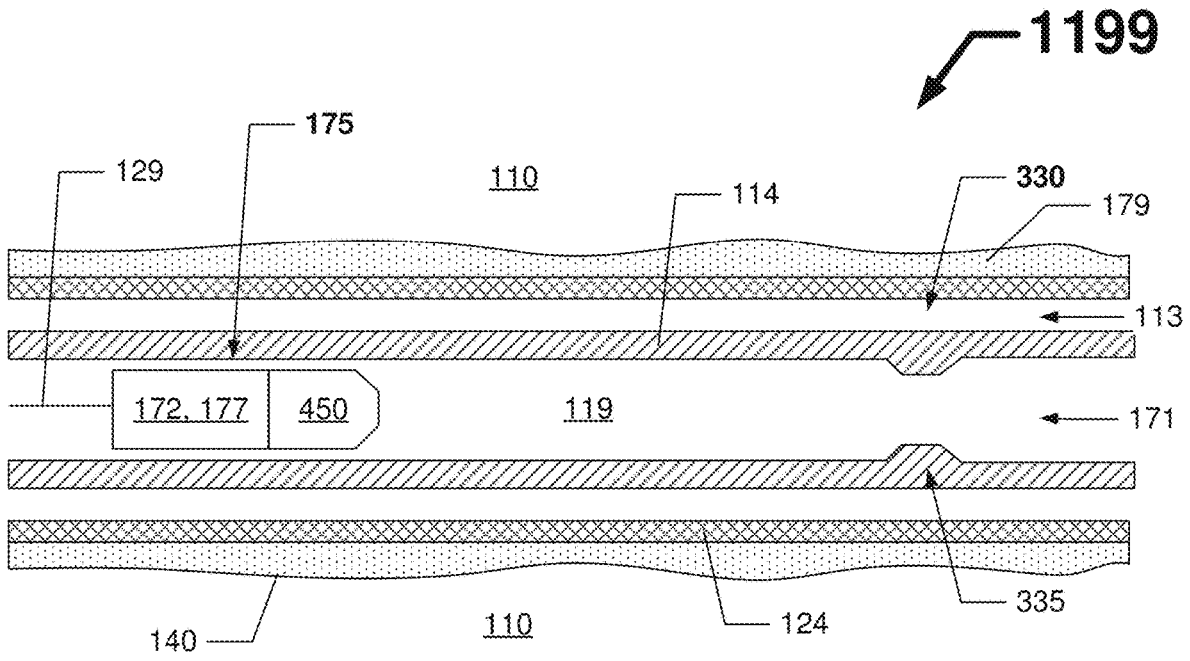
FIGS. 11 through 18 show subsystems at various points in time that capture part of the method in the flowchart of FIG. 10 according to certain example embodiments.
Figure 12:
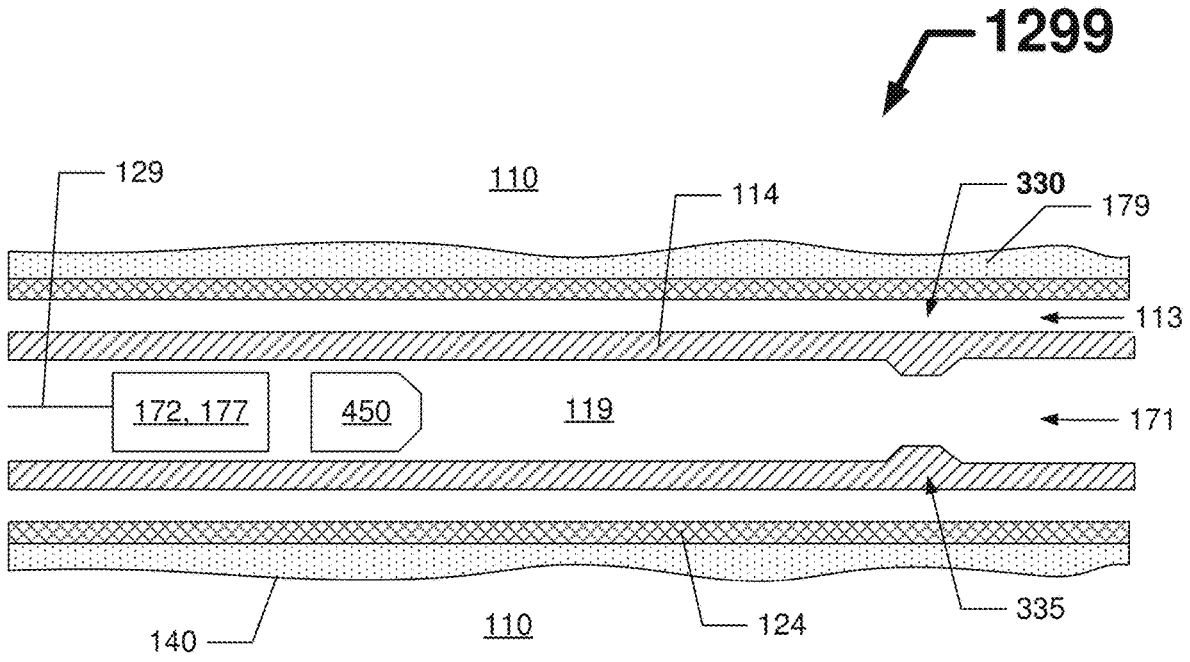
Figure 13:
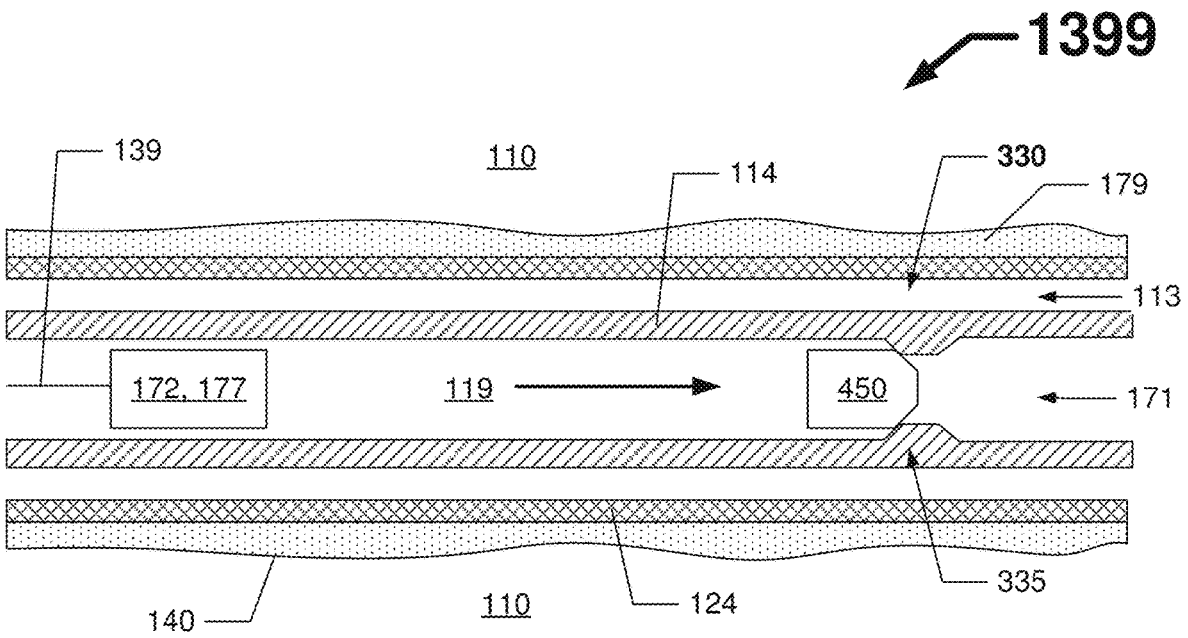
Figure 14:
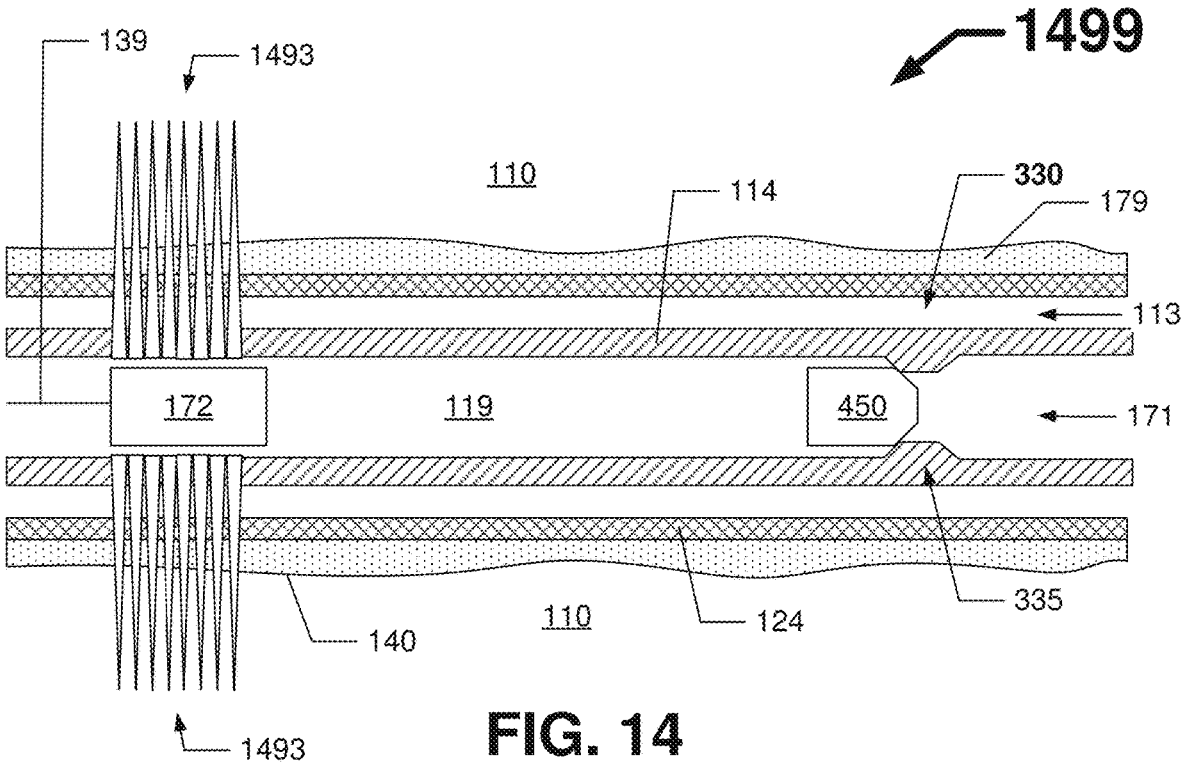
Figure 15:
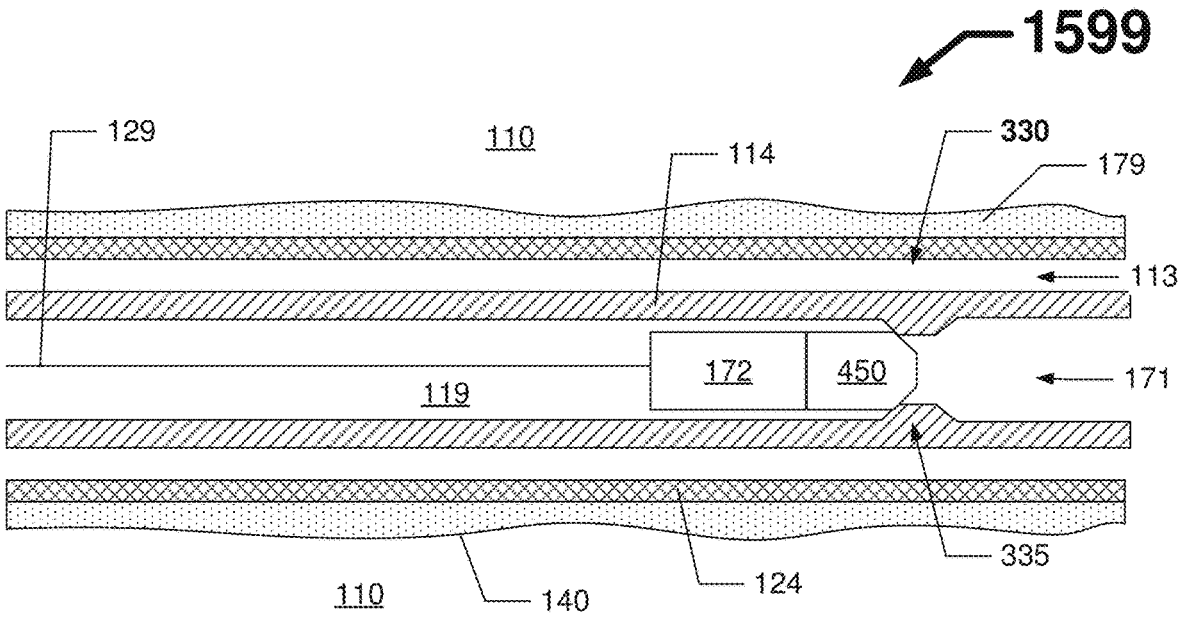
Figure 16:
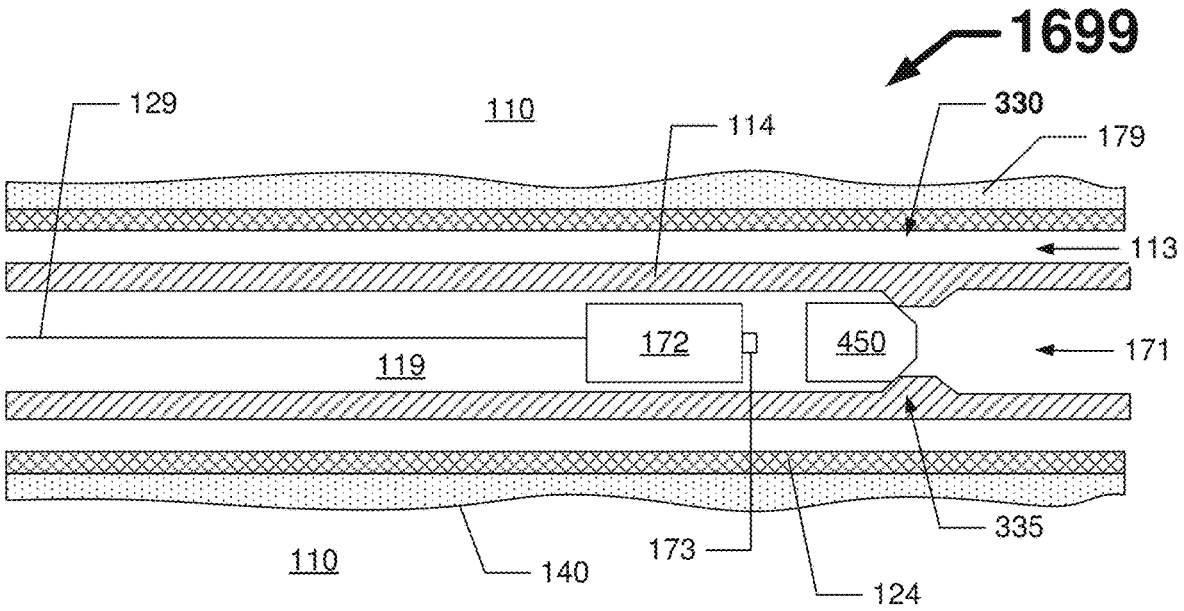
Figure 17:
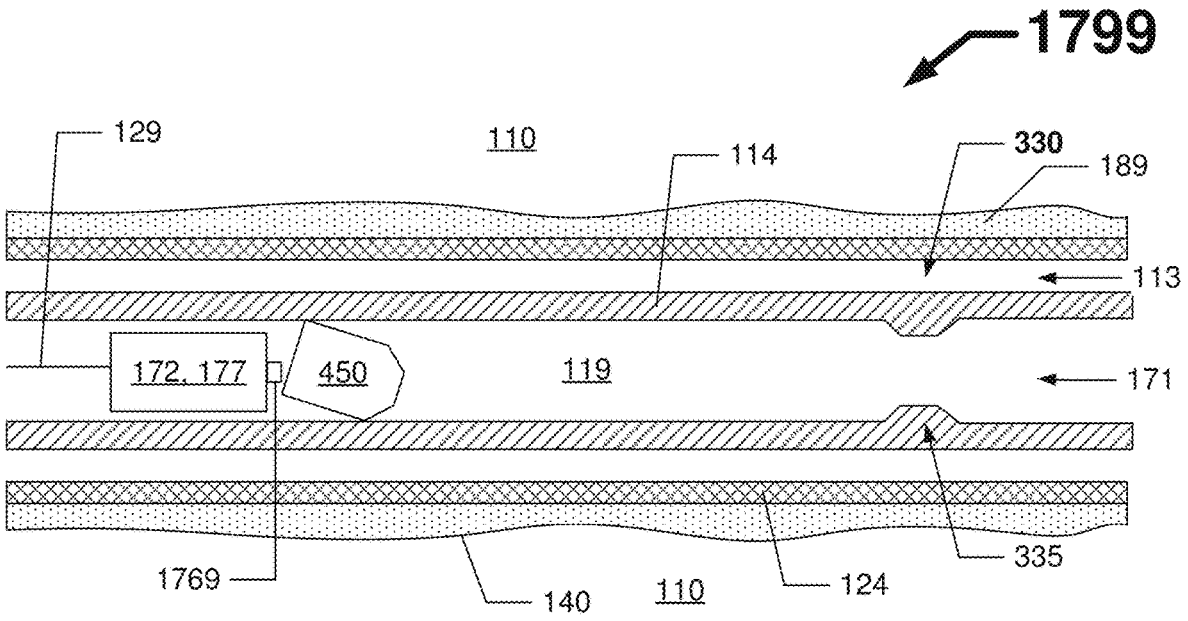
Figure 18:
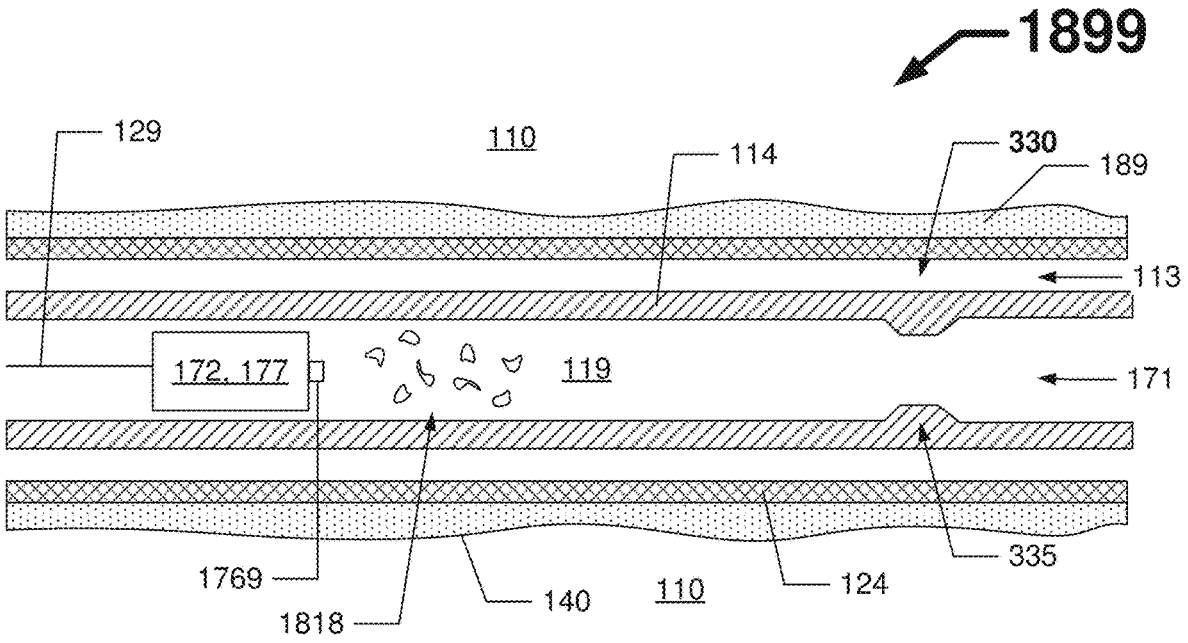

The subsystem 1199 of FIG. 11, the subsystem 1299 of FIG. 12, the subsystem 1399 of FIG. 13, the subsystem 1499 of FIG. 14, the subsystem 1599 of FIG. 15, the subsystem 1699 of FIG. 16, the subsystem 1799 of FIG. 17, and the subsystem 1899 of FIG. 18 include a wireline tool assembly 175 fed into the cavity 171 of the tubing string 114 using a wireline 129, the wet shoe sub 330 of FIG. 3 integrated with the tubing string 114, a casing string 124, an annulus 123 between the tubing string 114 and the casing string 124, and cement 179 between the casing string 124 and the wall 140 in the subterranean formation 110 that forms the wellbore (e.g., wellbore 120). The wireline tool assembly 175 includes the example wireline conveyed casing test tool 450 of FIGS. 4A through 4C, the wireline tool 172 of FIG. 2, and a gun string 177. Working fluid 119 is disposed within the cavity 171 of the tubing string 114.

Referring to the description above with respect to FIGS. 1 through 9, the method shown in the flowchart 1080 of FIG. 10 begins at the START step and proceeds to step 1081, where the wireline tool assembly 175 is inserted into the horizontal section 103 of the cavity 171 of the tubing string 114 within the wellbore 120. The wireline tool assembly 175 may be inserted into the horizontal section 103 of the wellbore 120 by a user and/or a controller using a wireline base 189 at or near the surface 102, a wireline 129, and/or other parts of a wireline system 170 known in the art. The wireline tool assembly 175 is lowered through the vertical section 104 of the wellbore 120 before getting to the horizontal section 103. The wireline tool assembly 175 includes an example wireline conveyed casing test tool 450. In some cases, the wireline tool assembly 175 may be inserted into the cavity 171 of the tubing string 114 within the horizontal section 103 of the wellbore 120 until the wireline tool assembly 175 is adjacent to the wet shoe sub 330 within the horizontal section 103.

FIG. 11 shows a subsystem 1199 at a point in time that captures an example of step 1081 being performed according to certain example embodiments. Specifically, the wireline conveyed casing test tool 450 is coupled to the remainder (in this case, the wireline tool 172 and the gun string 177) of the wireline tool assembly 175 within the cavity 171 of the tubing string 114. There is some distance (e.g., a few feet, a few hundred feet, a few thousand feet) that separates the wireline conveyed casing test tool 450 from the seat 335 of the wet shoe sub 330 in the subsystem 1199 of FIG. 11. The working fluid 119 may be flowing or stationary within the cavity 171 of the tubing string 114 at this time. The wireline conveyed casing test tool 450 may be coupled to the wireline tool 172 (or other component of the wireline tool assembly 175) using a coupling feature (e.g., known in the art) of the wireline tool 172 and/or a coupling feature (e.g., coupling feature 453 discussed above) of the wireline conveyed casing test tool 450.

In step 1085, a determination is made as to whether the wireline conveyed casing test tool 450 is inserted to abut against the seat 335 of the wet shoe sub 330. In other words, a determination is made as to whether the wireline tool assembly 175, which includes the wireline conveyed casing test tool 450 at this point in the process, is inserted all that way to the seat 335 of the wet shoe sub 330 or stops at a point upstream of the seat 335 of the wet shoe sub 330 within the horizontal section 103 of the wellbore (e.g., wellbore 120). The determination may be made by a user. For example, a user may determine that the wireline tool assembly 175 should only travel a certain distance within the horizontal section 103 of the wellbore, and so insertion of the wireline tool assembly 175 stops when a certain amount of the wireline 129 has been unspooled, even if the wireline tool assembly 175 is short of the seat 335 of the wet shoe sub 330.

As another example, a user may determine that the wireline tool assembly 175 should abut against the seat 335 of the wet shoe sub 330, in which case the wireline 129 is unspooled until there is slack in the wireline 129. If the wireline conveyed casing test tool 450 is inserted to abut against the seat 335 of the wet shoe sub 330, as discussed below and as shown in FIG. 15, then the process proceeds to step 1084. If the wireline conveyed casing test tool 450 is not inserted to abut against the seat 335 of the wet shoe sub 330 within the horizontal section 103 of the wellbore, then the process proceeds to step 1082.

In step 1082, the wireline conveyed casing test tool 450 is released from the remainder of the wireline tool assembly 175. Step 1082 is an optional step in the event that a user does not want to insert the wireline tool assembly 175 (which includes the wireline conveyed casing test tool 450) into the horizontal section 103 of the wellbore until the wireline conveyed casing test tool 450 abuts against the seat 335 of the wet shoe sub 330. Releasing the wireline conveyed casing test tool 450 may occur through the wireline 129 (e.g., via a controller, via a user-initiated signal). In addition, or in the alternative, releasing the wireline conveyed casing test tool 450 may occur with the use of a timer. The wireline conveyed casing test tool 450 may be released from the remainder of the wireline tool assembly 175 when the wireline tool assembly 175 is positioned within the horizontal section 103 of the wellbore 120. The wireline conveyed casing test tool 450 may be positioned at the distal end of the wireline tool assembly 175 so that its release may not affect the operation of the remaining components of the wireline tool assembly 175.

FIGS. 11 and 12 show a subsystem 1299 at a point in time that captures a point in time just before and just after, respectively, an example of step 1082 being performed according to certain example embodiments. The point in time that captures the subsystem 1299 of FIG. 12 is subsequent to the point in time that captures the subsystem 1199 of FIG. 11. Specifically, the wireline conveyed casing test tool 450 is released and physically separated from the remainder (e.g., the wireline tool 172) of the wireline tool assembly 175. The wireline conveyed casing test tool 450 may be released from the wireline tool 172 (or other component of the wireline tool assembly 175) by decoupling a coupling feature (e.g., known in the art) of the wireline tool 172 from a coupling feature (e.g., coupling feature 453 discussed above) of the wireline conveyed casing test tool 450.

Alternatively, if the wireline conveyed casing test tool 450 is housed within the wireline tool 172 or some other component of the wireline tool assembly 175, then the wireline tool 172 or other component may open or otherwise allow the wireline conveyed casing test tool 450 to be released without the use of coupling features. In any case, when the wireline conveyed casing test tool 450 is released from the remainder of the wireline tool assembly 175, there remains some distance (e.g., a few feet, a few hundred feet, a few thousand feet) that separates the wireline conveyed casing test tool 450 from the seat 335 of the wet shoe sub 330, as shown in the subsystem 1299 of FIG. 12. The working fluid 119 may be flowing or stationary (i.e., operation of the wellbore circulation system 109 is paused) within the cavity 171 of the tubing string 114 at this time.

In step 1083, working fluid 119 is injected into the cavity 171 of the tubing string 114. The working fluid 119 may be injected using the wellbore circulation system 109 and the circulation line 121 discussed above. Injecting the working fluid 119 into the cavity 171 of the tubing string 114 generates of flow of the working fluid 119 within the cavity 171 downhole, which in turn causes the working fluid 119 to carry the wireline conveyed casing test tool 450 toward the seat 335 of the wet shoe sub 330. When this occurs, the wireline conveyed casing test tool 450 eventually lodges against the seat 335 of the wet shoe sub 330 to create a seal with the seat 335 of the wet shoe sub 330. An example of this is shown with the subsystem 1399 of in FIG. 13. The point in time that captures the subsystem 1399 of FIG. 13 is subsequent to the point in time that captures the subsystem 1299 of FIG. 12.

In step 1084, a determination is made as to whether the wireline conveyed casing test tool 450 forms a seal with the seat 335 of the wet shoe sub 330. In some cases, the determination may be based on environmental data from the wellbore. For example, the determination may be based, for example, on a pressure spike that occurs within the cavity 171 of the tubing string 114 when the wireline conveyed casing test tool 450 creates a seal with the seat 335 of the wet shoe sub 330. In such a case, the pressure may be measured by a sensor device (e.g., a pressure sensor device, a differential pressure sensor device) that is part of the wellbore circulation system 109, that is part of the wireline system 170 (e.g., integrated with or coupled to the wireline tool 172), and/or that is standalone component within the field system 100.

The determination as to whether the wireline conveyed casing test tool 450 forms a seal with the seat 335 of the wet shoe sub 330 may be made by a user and/or a controller. Testing the pressure within the cavity 171 of the tubing string 114 within the wellbore 120 may confirm that the wireline conveyed casing test tool 450 is lodged against the seat 335 of the wet shoe sub 330 to form a sufficient seal. In addition, or in the alternative, the determination may be made based on one or more of a number of other factors, including but not limited to the passage of time since the wireline tool assembly 175 is run into the wellbore or the horizontal section 103 of the wellbore, the rate at which the wireline tool assembly 175 is run into the wellbore or the horizontal section 103 of the wellbore, and the flow rate and/or pressure of the return fluid 192.

In some cases, one or more other sensor devices may be used to help make the determination as to whether the wireline conveyed casing test tool 450 forms a seal with the seat 335 of the wet shoe sub 330. Once the wireline conveyed casing test tool 450 forms a seal with the seat 335 of the wet shoe sub 330, the ability to pump working fluid 119 into the cavity 171 of the tubing string 114 using the wellbore circulation system 109 may be reduced or eliminated.

In the event that the wireline conveyed casing test tool 450 remains connected to and integrated with the wireline tool assembly 175 when testing is performed to confirm that a sufficient seal exists between the wireline conveyed casing test tool 450 and the seat 335 of the wet shoe sub 330, the wireline conveyed casing test tool 450 is released from the remainder of the wireline tool assembly 175 after confirmation of the seal. The process of releasing the wireline conveyed casing test tool 450 from the remainder of the wireline tool assembly 175 may be substantially the same as what is described above with respect to step 1082. After the wireline conveyed casing test tool 450 is released, the wireline conveyed casing test tool 450 remains abutted against the seat 335 of the wet shoe sub 330, and the seal between the wireline conveyed casing test tool 450 and the seat 335 of the wet shoe sub 330 is maintained.

Also, as shown by the subsystem 1699 of FIG. 16, the remainder of the wireline tool assembly 175 is retracted (i.e., moved upstream) within the cavity 171 of the tubing string 114 until the remainder of the wireline tool assembly 175 is positioned at a point within the cavity 171 of the tubing string 114 where a field operation (e.g., perforating) is to be performed. FIG. 16 also shows a release mechanism 173 located at the distal end of the wireline tool 172. The release mechanism 173 is configured to retain the wireline conveyed casing test tool 450 as the wireline assembly 175 is lowered into the wellbore. Once the wireline conveyed casing test tool 450 is positioned at the desired location within the horizontal section of the wellbore, the release mechanism 173 is configured to release the wireline conveyed casing test tool 450 so that the remainder of the wireline assembly 175 can be retracted while leaving the wireline conveyed casing test tool 450 in place within the horizontal section of the wellbore.

In some cases, the release mechanism 173 may be a specialized tool or component designed for conveying and releasing the wireline conveyed casing test tool 450. In alternative embodiments, the release mechanism 173 may be an existing tool or component used for the purpose of conveying and releasing the wireline conveyed casing test tool 450. For example, the release mechanism 173 may be or include a setting tool used for fracturing plugs, bridge plugs, and/or dummy plugs. If the wireline conveyed casing test tool 450 forms a seal with the seat 335 of the wet shoe sub 330, then the process proceeds to step 1087. If the wireline conveyed casing test tool 450 does not form a seal with the seat 335 of the wet shoe sub 330, then the process proceeds to step 1086.

In step 1086, the wireline conveyed casing test tool 450 may optionally be broken down using the wireline tool 172 or, more broadly, a part of the remainder of the wireline tool assembly 175. In such a case, the wireline tool 172 may be positioned proximate to the wireline conveyed casing test tool 450 within the cavity 171 of the casing string 114 using the wireline base 189 and the wireline 129. For this to occur, the remainder of the wireline tool assembly 175 is inserted further into the cavity 171 of the tubing string 114 in the horizontal section 103 of the wellbore 120. Similarly, the process of breaking down the wireline conveyed casing test tool 450 may be aided by the use of the wireline base 189 and the wireline 129. This step 1086 is taken if the wireline conveyed casing test tool 450 becomes stuck within the cavity 171 of the tubing string 114 or loses its proper orientation (e.g., the distal end 455 of the wireline conveyed casing test tool 450 is no longer closest to the seat 355 of the wet shoe sub 330) within the cavity 171 of the tubing string 114.

For example, as shown by the subsystem 1799 of FIG. 17 and the subsystem 1899 of FIG. 18, the wireline conveyed casing test tool 450 may be broken down using a specialized tool 1769 (e.g., a drill). Specifically, the subsystem 1799 of FIG. 17 shows a point in time just before the wireline conveyed casing test tool 450 is broken apart by inserting the remainder of the wireline tool assembly 175 into the wellbore until the specialized tool 1769 contacts the wireline conveyed casing test tool 450. In this case, the wireline conveyed casing test tool 450 is wedged within the cavity 171 of the tubing string 114 upstream of the wet shoe sub 330, and so the wireline conveyed casing test tool 450 is unable to reach the seat 335 of the wet shoe sub 330 to form a seal with the seat 335. The subsystem 1899 of FIG. 18 shows a point in time just subsequent to what is shown in FIG. 17. Specifically, in FIG. 18, the wireline conveyed casing test tool 450 is broken into multiple pieces 1818, which frees the obstruction in the cavity 171 of the tubing string 114. In some cases, each of the multiple pieces 1818 is small enough to pass through the seat 335 of the wet shoe sub 330 when the working fluid 119 is flowing. Once the wireline conveyed casing test tool 450 is broken into multiple pieces 1818, the remainder of the wireline tool assembly 175 is extracted from the wellbore (in a manner similar to what is described below with respect to step 1088) so that another wireline conveyed casing test tool 450 may be added to the wireline tool assembly 175. When this occurs, the process reverts to step 1081, and the process is repeated until the wireline conveyed casing test tool 450 forms an effective seal with the seat 335 of the wet shoe sub 330.

In step 1087, a field operation is performed. In such a case, the field operation is performed upstream of the wet shoe sub 330 and while the wireline conveyed casing test tool 450 forms a seal with the seat 335 of the wet shoe sub 330. In this way, any equipment, the BHA 101, and/or other components of a field system 100 located downstream of the seat 335 of the wet shoe sub 330 may be protected from the effects of the field operation. A field operation may vary and be determined by the part of the overall process currently in existence. For example, a field operation may be creating perforations through a first stage of the casing string 124 and cement 179 after the cement 179 has set.

An example of such a field operation is shown in the subsystem 1499 of FIG. 14. In this case, the gun string 177 of the wireline tool assembly 175 is deployed, forming perforations 1493 that extend through the tubing string 114, the casing string 124, the cement 179, and the adjacent subterranean formation 110. In this way, the gun string 177 perforates a portion of the horizontal section 103 of the wellbore 120 upstream from the wet shoe sub 330 after the wireline conveyed casing test tool 450 is lodged against the seat 335 of the wet shoe sub 330. The resulting detonations used to generate the perforations 1493 may cause a significant increase in pressure (e.g., at least 9800 psia) within the cavity 171, and the wireline conveyed casing test tool 450 may be configured to withstand such high pressures, even for sustained periods of time (e.g., at least 2 weeks), without breaking the seal that the wireline conveyed casing test tool 450 forms with the seat 335 of the wet shoe sub 330.

In this way, the seal generated between the wireline conveyed casing test tool 450 and the seat 335 of the wet shoe sub 330 may be maintained to protect downstream equipment and well integrity when fracturing operations begin. Also, maintaining the seal between the wireline conveyed casing test tool 450 and the seat 335 of the wet shoe sub 330 may help ensure that fractures generated during a subsequent fracturing operation are propagated through the perforations rather than through the wet shoe sub 330. Those of ordinary skill in the art will appreciate that any of a number of additional or alternative field operations may be performed during this step 1087.

In some cases, prior to performing a field operation, a casing test (also sometimes called a casing shoe test) may be performed to ensure that the cement is set properly and the casing string 124 is secured within the wellbore 120. The casing test is a pressure test conducted after drilling into the confining strata within the subterranean formation 110 below a cemented casing string seat to evaluate pressure containment integrity and to determine the maximum fluid density that the strata can contain without breaking down.

In step 1088, the wireline tool assembly 175 is extracted from the cavity 171 of the tubing string 114 within the wellbore 120. The wireline tool assembly 175 may be extracted using the wireline base 189 and the wireline 129. When step 1087 is completed, the process proceeds to the END step.

Example embodiments may be used to provide systems and methods for isolating a wet shoe sub in a horizontal section of a wellbore. Example embodiments result in reliable sealing at the seat of a wet shoe sub. The example wireline conveyed casing test tool may be configured to withstand high pressures for extended periods of time to allow for safe and reliable field operations upstream of the wet shoe sub. As a result, example embodiments greatly reduce or eliminate unnecessary downtime that results from failed sealing or attempts to seal at the wet shoe sub. Example embodiments can be used with new wet shoe subs or existing wet shoe subs. Example embodiments may provide a number of benefits. Such benefits may include, but are not limited to, more reliable field operations, ease of installation and use, reduced downtime, increased flexibility, configurability, and compliance with applicable industry standards and regulations.

Although embodiments described herein are made with reference to example embodiments, it should be appreciated by those skilled in the art that various modifications are well within the scope of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A method for isolating a wet shoe sub in a horizontal section of a wellbore, the method comprising:

inserting a wireline tool assembly to the horizontal section of the wellbore, wherein the wireline tool assembly comprises a wireline conveyed casing test tool;

releasing the wireline conveyed casing test tool from a remainder of the wireline tool assembly within the horizontal section of the wellbore; and perforating, using a gun string and after confirming that the wireline conveyed casing test tool is lodged against a seat of the wet shoe sub to create a seal with the seat of the wet shoe sub, a portion of the horizontal section of the wellbore upstream from the wet shoe sub after the wireline conveyed casing test tool is lodged against the seat of the wet shoe sub.

2. The method of claim 1, wherein confirming that the wireline conveyed casing test tool is lodged against the seat of the wet shoe sub comprises testing a pressure within the wellbore.

3. The method of claim 2, wherein the pressure is at least 9800 psi.

4. The method of claim 1, wherein the wireline tool assembly is inserted into the horizontal section of the wellbore until the wet show test tool abuts against the seat of the wet show sub, and wherein the wireline conveyed casing test tool is released from the remainder of the wireline tool assembly after confirming that the wireline conveyed casing test tool is lodged against the seat of the wet shoe sub.

5. The method of claim 4, further comprising:

retracting, after confirming that the wireline conveyed casing test tool is lodged against the seat of the wet shoe sub and before perforating the portion of the horizontal section, the remainder of the wireline tool assembly to a position upstream of the wet shoe sub in the horizontal section of the wellbore.

6. The method of claim 1, further comprising:

extracting, after perforating the portion of the horizontal section, the wireline tool assembly from the wellbore.

7. The method of claim 1, further comprising, prior to inserting the wireline tool assembly:

inserting a prior wireline tool assembly to the horizontal section of the wellbore, wherein the wireline tool assembly comprises a prior wireline conveyed casing test tool;

releasing the prior wireline conveyed casing test tool from a remainder of the prior wireline tool assembly within the horizontal section of the wellbore upstream of the seat of the wet shoe sub; and determining that the prior wireline conveyed casing test tool is lodged in the horizontal section upstream of the seat of the wireline conveyed casing test tool.

8. The method of claim 1, wherein determining that the prior wireline conveyed casing test tool is lodged in the horizontal section upstream of the seat of the wireline conveyed casing test tool results from a failed pressure test.

9. The method of claim 8, further comprising:

breaking down the prior wireline conveyed casing test tool using the remainder of the prior wireline tool assembly; and extracting the remainder of the prior wireline tool assembly from the wellbore.

10. The method of claim 1, further comprising:

running a pump, prior to confirming that the wireline conveyed casing test tool is lodged against the seat of the wet shoe sub, to inject fluid into the wellbore after releasing the wireline conveyed casing test tool upstream of the seat of the wet shoe sub in the horizontal section, wherein the fluid carries the wireline conveyed casing test tool to the wet shoe sub.

11. The method of claim 1, wherein the gun string is part of the remainder of the wireline tool assembly.

12. The method of claim 1, wherein the wireline conveyed casing test tool maintains the seal with the seat of the wet shoe sub for at least two weeks.

* * * * *